US007121258B2

(12) United States Patent
Nakamoto et al.

(10) Patent No.: US 7,121,258 B2
(45) Date of Patent: Oct. 17, 2006

(54) ELECTRONIC THROTTLE CONTROL DEVICE

(75) Inventors: Katsuya Nakamoto, Tokyo (JP); Kohji Hashimoto, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 51 days.

(21) Appl. No.: 11/067,750

(22) Filed: Mar. 1, 2005

(65) Prior Publication Data

US 2006/0042593 A1 Mar. 2, 2006

(30) Foreign Application Priority Data

Aug. 31, 2004 (JP) ..... P2004-252096

(51) Int. Cl.
*F02D 11/10* (2006.01)
*G06G 7/00* (2006.01)

(52) U.S. Cl. ..... 123/399; 123/361; 123/336; 701/103; 701/115

(58) Field of Classification Search ..... 123/399, 123/361, 336, 321, 480, 481, 490, 492–494; 701/103–105, 110, 112, 115
See application file for complete search history.

(56) References Cited

U.S. PATENT DOCUMENTS 6,595,184 B1 7/2003 Kondo
6,622,695 B1 * 9/2003 Kondo ..... 123/336
6,718,254 B1 * 4/2004 Hashimoto et al. ..... 701/110
6,751,544 B1 * 6/2004 Hashimoto et al. ..... 701/107
6,799,110 B1 9/2004 Hashimoto et al.
6,845,315 B1 * 1/2005 Hashimoto et al. ..... 701/114
6,935,308 B1 * 8/2005 Nakamoto et al. ..... 123/395
7,043,351 B1 * 5/2006 Grossmann et al. ..... 701/103
2005/0155571 A1 * 7/2005 Hanasato ..... 123/336

FOREIGN PATENT DOCUMENTS

JP 06-207538 A 7/1994
JP 07-279698 A 10/1999
JP 2003-161194 A 6/2003
JP 2003-193889 A 7/2003

* cited by examiner

*Primary Examiner*—Hai Huynh
(74) *Attorney, Agent, or Firm*—Sughrue Mion, PLLC

(57) ABSTRACT

Intake throttle valves 21*a* to 21*d* disposed on the intake pipes 15*a* to 15*d* for each cylinder of a multi-cylinder engine 10 are provided with motors 20*a* to 20*d* for controlling valve opening of the intake throttle valves. The microprocessor 31 controls throttle valve opening in response to a degree of stepping on an accelerator pedal 42 in cooperation with a program memory 32A. The control of valve opening by each motor is sequentially subject to time division processing in the exhaust stroke of each cylinder, and a current valve opening is stored and held by a feedback control circuit section 39, 69B, 69C in the other strokes, thereby the control burden on the microprocessor being reduced.

17 Claims, 15 Drawing Sheets

ELECTRONIC THROTTLE CONTROL DEVICE

BACKGROUND OF THE INVENTION

1. Field of the Invention

The present invention relates to an electronic throttle control device that drives to open and close intake throttle valves of a multi-cylinder engine by means of a microprocessor cooperating with a program memory and, more particularly, to a simplified electronic throttle control device in which the mentioned intake throttle valves and throttle valve control motors are disposed at plural places for each cylinder or for each cylinder group and are controlled just by a single microprocessor.

2. Description of the Related Art

In the field of multi-cylinder engine, it has been known to arrange an operation control device in which an intake control valve is disposed in an intake passage of each cylinder, and intake amount for each cylinder is controlled by controlling a valve-opening time of this intake control valve. For example, according to the later-discussed Japanese Patent Publication (unexamined) No. 279698/1995 titled "Internal Combustion Engine.", an intake control valve is disposed for each cylinder and, furthermore, an intake throttle valve acting commonly on all cylinders is disposed.

This is because controlling a small amount of intake air just by controlling an intake time using the intake control valve that performs the entire opening and closing operation becomes difficult during idling or the like, and it is necessary to suppress the entire intake amount by the throttle valve when accelerator pedal has been returned.

Further, the Japanese Patent Publication (unexamined) No. 193889/2003 titled "Intake Control Device of Multi-Cylinder Internal Combustion Engine" discloses another technology. Specifically, an intake control valve is disposed for each cylinder and, furthermore, an opening sensor for detecting a valve opening of the intake control valve is disposed. By controlling an intake valve opening, control of the idle engine speed is improved, thus omitting an intake throttle valve common to all cylinders.

Furthermore, the Japanese Patent Publication (unexamined) No. 207538/1994 titled "Throttle Valve Drive of Internal Combustion Engine" discloses a further technology. Specifically, in a six-cylinder engine, an intake throttle valve is disposed with respect to an intake pipe for each cylinder group comprised of three cylinders, and a mechanism is arranged to drive to open and close all throttles just by single unit of electric motor.

On the other hand, in relation to the present invention, the Japanese Patent Publication (unexamined) No. 161194/2003 titled "Engine Control Drive" discloses a detailed technology. Specifically, in an electronic throttle control for controlling electrically a throttle valve opening, in addition to an initial position return mechanism of a throttle valve drive mechanism, error determination means and non-detective item determination means for an accelerator position sensor and a throttle position sensor are disclosed.

SUMMARY OF THE INVENTION (1) Description of the Problems Incidental to the Prior Art The prior arts disclosed in both of the mentioned Japanese Patent Publications (unexamined) Nos. 279698/1995 and 193889/2003 are of a type of controlling a valve-opening time of the intake control valve, and it is necessary for this type of intake control valve to open and close the intake control valve at high speed for every intake stroke of each cylinder. Accordingly, power consumption of the drive control circuit is increased, and wear and tear of an open-and-close operation mechanism is considerable. Hence a problem exists in that in order to secure a sufficient life of control, the device is unavoidably large-scaled and expensive.

In the prior art disclosed in the Japanese Patent Publication (unexamined) No. 207538/1994, a problem exists in that arrangement of the mechanism for driving a pair of intake throttle valve by a single unit of motor becomes rather complicated. In the prior art disclosed in the Japanese Patent Publication (unexamined) No. 161194/2003, a problem exists in that since a total amount of intake air is controlled by a single unit of throttle valve covering all cylinders of the multi-cylinder engine, a distance between the throttle valve and each cylinder is unavoidably elongated, eventually resulting in lowering of acceleration-deceleration response of the engine.

(2) Description of the Objects and Features of the Invention

A first object of the present invention is to provide an electronic throttle control device for use in a multi-cylinder engine, in which any complicated arrangement of mechanism is not required, and of which life is long, power consumption is small and acceleration-deceleration response is superior.

A second object of the invention is to provide an electronic throttle control device capable of reducing control burden on a microprocessor cooperating with a program memory acting as target throttle valve opening setting means.

A third object of the invention is to provide an electronic throttle control device capable of maintaining an appropriate air/fuel ratio and reducing poisonous exhaust gas even under the condition of performing an in take of which amount is different for each individual cylinder.

In order to accomplish the foregoing objects, an electronic throttle control device according to the present invention includes a drive control section of a motor that drives to open and close intake throttle valves of a multi-cylinder engine by a microprocessor cooperating with a program memory. The mentioned intake throttle valves and throttle valve opening control motors are disposed at plural places separately for each cylinder or each cylinder group. Further, the mentioned program memory contains a program acting as target throttle valve opening setting means, a program acting as sequential control means, and a program acting as holding throttle valve opening storage means. The mentioned drive control circuit section includes a feedback control circuit section acting with functions separated.

The mentioned target throttle valve opening setting means is means for setting a target throttle valve opening separately for each cylinder or each cylinder group, the target throttle valve opening being obtained by adding or subtracting a compensation output generated conforming to operating conditions on the basis of detection outputs of acceleration position sensors, that detect a degree of stepping on an accelerator pedal. The mentioned sequential control means is means for making available only an adjustment and control of the valve opening of the intake throttle valve for a cylinder remaining a predetermined time period immediately before an intake stroke, in response to a crank angle sensor that detects a turning angle position of a crankshaft.

The mentioned holding throttle valve opening storage means is means for storing a current target value varying in accordance with the mentioned target throttle valve opening when the control of throttle valve opening is available by the mentioned sequential control means, and storing and holding a value of the target throttle valve opening at the moment immediately before making the control unavailable to establish a holding throttle valve opening when the control of throttle valve opening is made unavailable.

The mentioned feedback control circuit section is a control circuit section for on/off-controlling switching elements disposed on a power supply circuit of each of the motors so that a detection output of the throttle position sensors detecting a throttle valve opening is equal to the mentioned target throttle valve opening or the mentioned holding throttle valve opening, and in which control burden on the mentioned microprocessor is reduced by sequentially executing the valve opening control for the plural motors.

As described above, in the electronic throttle valve control device according to the invention, the throttle valve opening of the intake pipe for each cylinder or the intake pipe for each cylinder group is electrically controlled in response to a degree of stepping on the accelerator pedal, and an advantage is obtained such that acceleration-deceleration of the engine can be improved by shortening the piping distance between the throttle valve and the cylinder. Further, since the throttle valve opening is held at a certain value during steady running, another advantage is obtained such that power consumption of the electric control mechanism is reduced, and wear and tear of the opening and closing mechanism of the throttle valve is also reduced. Furthermore, since the control of throttle valve opening is sequentially subject to time-division processing so as not to overlap in each cylinder, control burden on the microprocessor is not increased, and it is possible to make all of a series of controls such as fuel injection control, ignition control, etc. simply with the use of just one microprocessor.

Since the motor control is sequentially carried out, a further advantages are obtained such that diameter of wire in the power supply system is prevented from being increased; current rating of power supply fuse is restrained from being increased; width of copper foil pattern of electronic substrate in the operation control apparatus is restrained from being increased; drive noise is prevented from being increased; and capacity of an anti-noise capacitor in the operation control apparatus is prevented from being increased.

DETAILED DESCRIPTION OF THE INVENTION

Embodiment 1.

Figure 1:
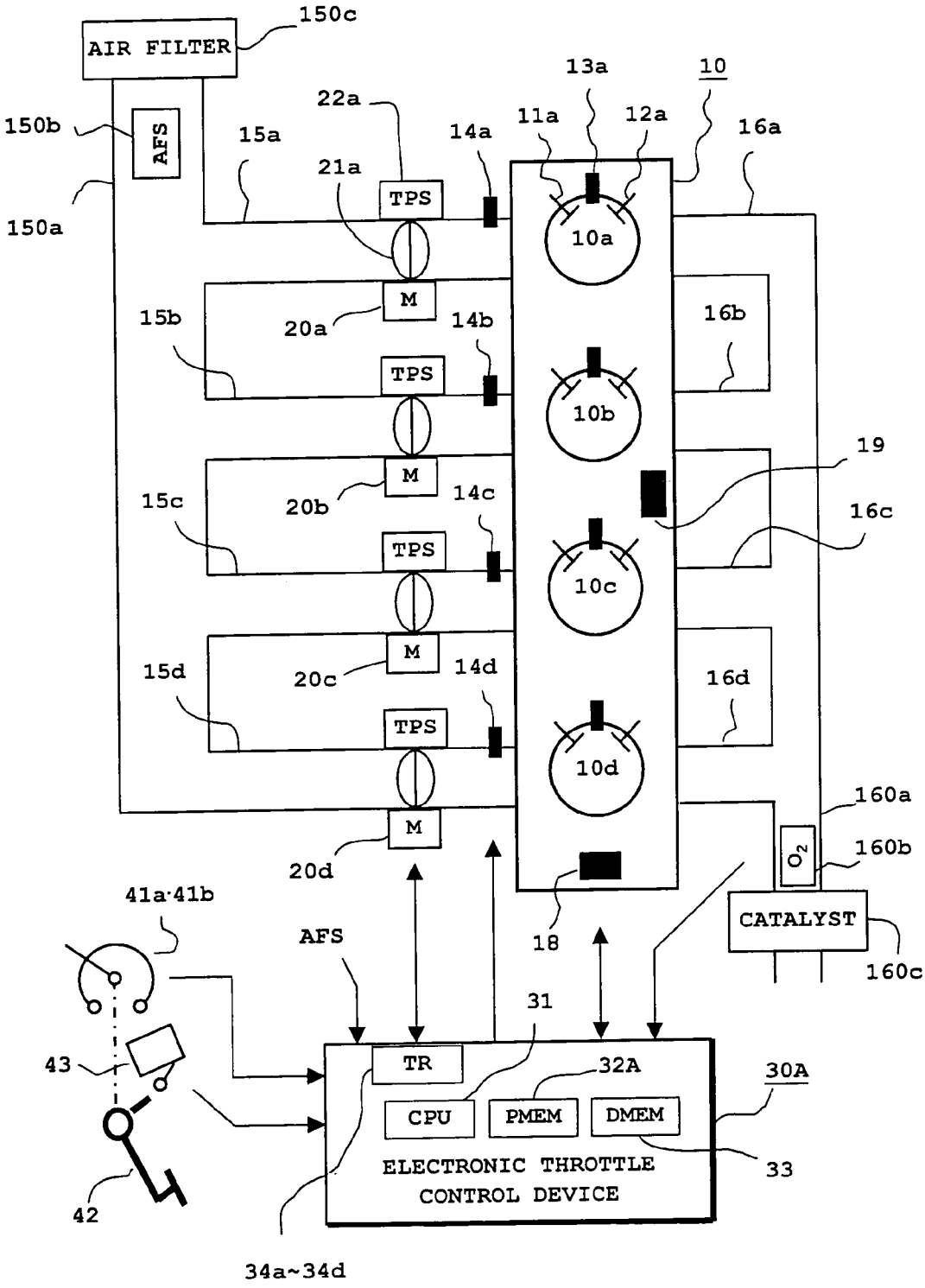
FIG. 1 is a schematic diagram showing an entire mechanism of an electronic throttle control device for a multi-cylinder engine according to Embodiment 1 of the present invention.

(1) Detailed Description of the Features of Embodiment 1:

An electronic throttle control device for a multi-cylinder engine according to Embodiment 1 of the present invention is hereinafter described with reference to FIG. 1 showing an entire mechanism of the electronic throttle control device. Referring to FIG. 1, a multi-cylinder engine 10 is shown as a four-cylinder engine having cylinders 10*a*, 10*b*, 10*c* and 10*d*. The cylinders 10*a* to 10*d* are respectively provided with intake valves 11*a* to 11*d* and exhaust valves 12*a* to 12*d* each interlocking with turning of a crankshaft not illustrated. In the case where the multi-cylinder engine 10 is a gasoline engine, ignition plugs 13*a* to 13*d* are used. (In the drawing, indication of reference numerals 11*a* to 11*d*, 12*a* to 12*d* and 13*a* to 13*d* is omitted.)

Fuel-injecting electromagnetic valves 14*a* to 14*d* are disposed in the vicinity of the intake valves 11*a* to 11*d*. Intake pipes 15*a* to 15*d* disposed for each cylinder and communicating to the intake valves 11*a* to lid form an intake passage to outside air via an intake collecting pipe 150*a*, an airflow sensor 150*b* and an air filter 150*c*.

Exhaust pipes 16*a* to 16*d* disposed for each cylinder and communicating to the exhaust valves 12*a* to 12*d* form an exhaust passage to outside air via an exhaust collecting pipe 160*a*, an exhaust gas sensor 160*b* and a catalyst 160*c* for purifying the exhaust gas.

Motors 20*a* to 20*d* drives to open and close intake throttle valves 21*a* to 21*d* for the purpose of making increase-decrease control of an amount of intake air passing through the intake pipes 15*a* to 15*d* for each cylinder, and valve opening of the intake throttle valves 21*a* to 21*d* is detected by throttle position sensors 22*a* to 22*d*. (In the drawing, indication of reference numerals 21*b* to 21*d*, and 22*b* to 22*d* is omitted.)

In addition, the fuel-injecting electromagnetic valves 14*a* to 14*d* are disposed between the intake throttle valves 21*a* to 21*d* and the intake valves 11*a* to 11*d*, and the airflow sensor 150*b* and the exhaust gas sensor 160*b* are disposed inside the intake collecting pike 150*a* and the exhaust collecting pipe 160*a*. In this manner, total amount of intake for all cylinders 10*a* to 10*d* and oxygen concentration of the whole exhaust gas are detected.

A crank angle sensor 18 is disposed on the crankshaft not illustrated. This crank angle sensor 18 is used in measuring fuel injection timing and ignition timing, and acts as signal means for calculating an engine speed of an engine. A water temperature sensor 19 is used in measuring a cooling water temperature of the engine to stably maintain an idle engine speed. An electronic throttle control device 30A is mainly comprised of a microprocessor 31. This microprocessor 31 makes on/off control of switching elements 34*a* to 34*d* in cooperation with a program memory 32A being a nonvolatile memory such as flash memory and a data memory 33, and makes a power supply control of the motors 20*a* to 20*d* so that valve opening of the intake throttle valves 21*a* to 21*d* may be a target valve opening.

In addition, input signals from a pair of accelerator position sensors 41*a*, 41*b* disposed in dual system to detect a degree of stepping on the acceleration pedal 42 and from an idle switch 43 acting at the return position of the accelerator pedal 42 are connected to the electronic throttle control device 30A, so that valve opening of the intake throttle valves 21*a* to 21*d* is controlled to increase or decrease in response to a degree of stepping on the accelerator pedal 42. The microprocessor controls a valve-opening time period of the fuel-injecting electromagnetic valves 14*a* to 14*d* based on the total intake amount detected by the airflow sensor 150*b* and the exhaust oxygen concentration detected by the exhaust gas sensor 160*b*, so that an appropriate A/F (air weight/fuel weight ratio) may be maintained by controlling the fuel for each cylinder.

Figure 2:
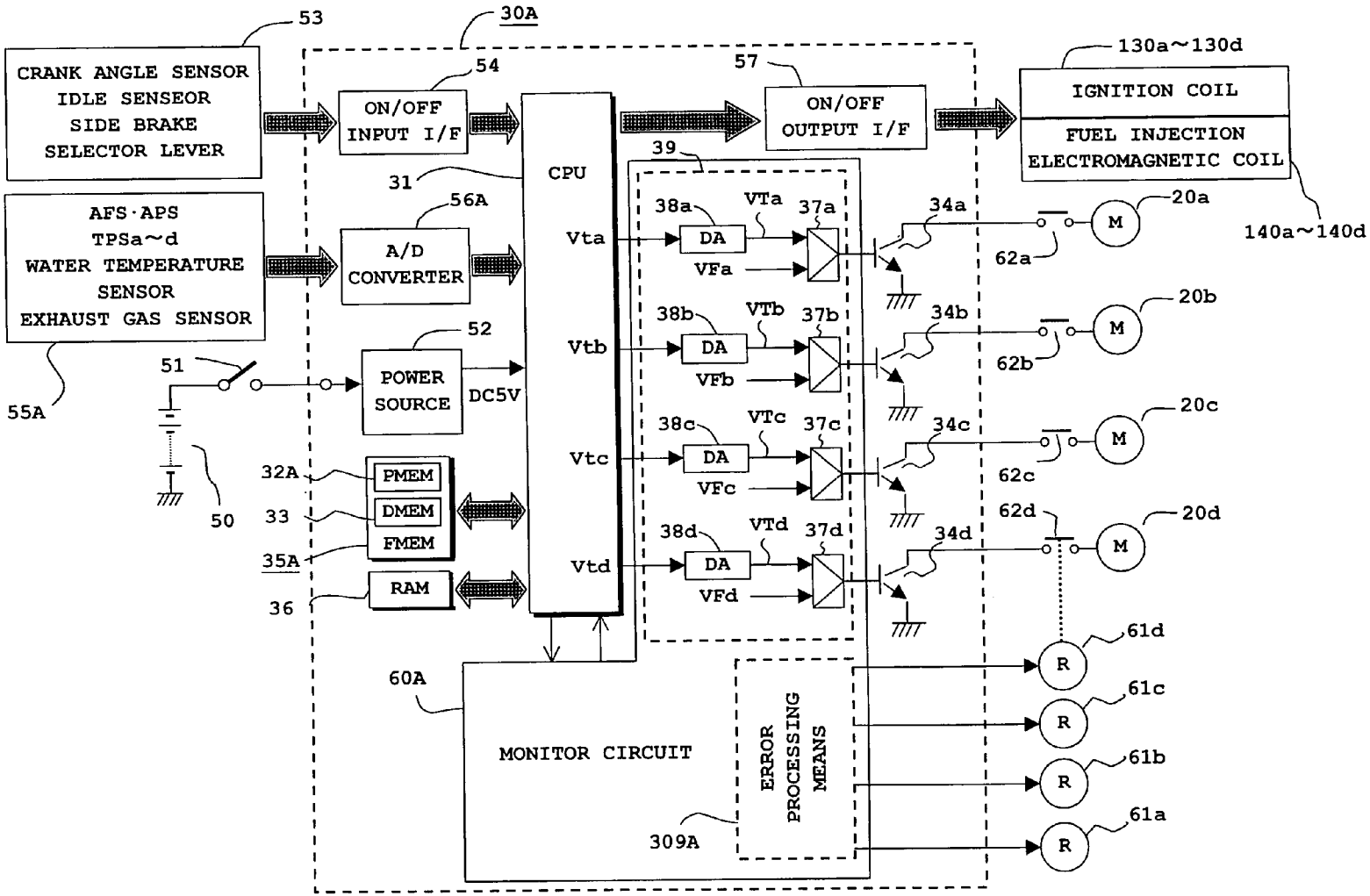
FIG. 2 is a block diagram showing the whole of control blocks of the electronic throttle control device for a multi-cylinder engine according to Embodiment 1 of the invention.

Referring now to FIG. 2 showing a block diagram of the entire control carried out by the control device of FIG. 1, the microprocessor 31 forming the electronic throttle control device 30A includes a nonvolatile flash memory 35A such as flash memory having a program memory region 32A and a data memory region 33 and a RAM memory 36 for arithmetic processing, so as to on/off control of the switching elements 34*a* to 34*d* via a feedback control circuit section 39. This feedback control circuit section 39 operates using target digital values VTa to VTd of the throttle valve opening being control outputs of the microprocessor 31 as input, and is provided with DA converters 38*a* to 38*d* generating target analog values VTa to VTd and comparison control circuits 37*a* to 37*d*. The target analog values VTa to VTd are connected to one input of the comparison control circuits 37*a* to 37*d*, and feedback analog values VFa to VFd being valve opening detecting outputs are by the throttle position sensors 22*a* to 22*d* are connected to the other input.

In addition, the switching elements 34*a* to 34*d* actually drive the motors 20*a* to 20*d* normal and reverse by means of four transistors each forming a H-shaped bridge circuit. A monitor control circuit section 60A used in combination with the microprocessor 31 is arranged so as to communicate with each other via a serial communication circuit, and energize load power relays 61*a* to 61*d* under the normal state not operating a later described error processing means 309A to close output contacts 62*a* to 62*d* provided on the power supply circuit located between the switching elements 34*a* to 34*b* and the motors 20*a* to 20*d*.

However, in the case where any error such as disconnection and/or short circuit occurs in the power supply circuit to the motor 20*a* to 20*d* or when any error such as disconnection and/or short circuit occurs in the detection circuit of the mentioned throttle position sensors 22*a* to 22*d*, the load power relays 61*a* to 61*d* of the system where the error occurs are de-energized, and a power circuit of the motor, to which output contacts of the load power relays are connected, is interrupted.

In addition, the electronic throttle control device 30A is supplied with power from an on-vehicle battery 50 through a power switch 51 so as to operate obtaining a constant voltage of dc 5V from a constant voltage power circuit 52. Further, input sensor group 53 for carrying out on/off operation of crank angle sensor 18, an idle switch 43, a side break switch, selector switch, etc. not illustrated is bus-connected to the microprocessor 31 via an input interface 54.

Likewise input sensor group 55A for the mentioned airflow sensor 150*b*, accelerator position sensors 41*a*, 41*b*, throttle position sensors 22*a* to 22*d*, water temperature sensor 19, exhaust gas sensor 160*b*, etc. is bus-connected to the microprocessor 31, after being digital-converted through a multi-channel SD converter 56A. Ignition coils 130*a* to 130*d* for applying a high voltage to the mentioned ignition plugs 13*a* to 13*d* and electromagnetic coils 140*a* to 140*d* for driving the fuel-injecting electromagnetic valves 14*a* to 14*d* are bus-connected to the microprocessor 31 via an output interface 57 formed of a latch memory and a power transistor.

Figure 3:
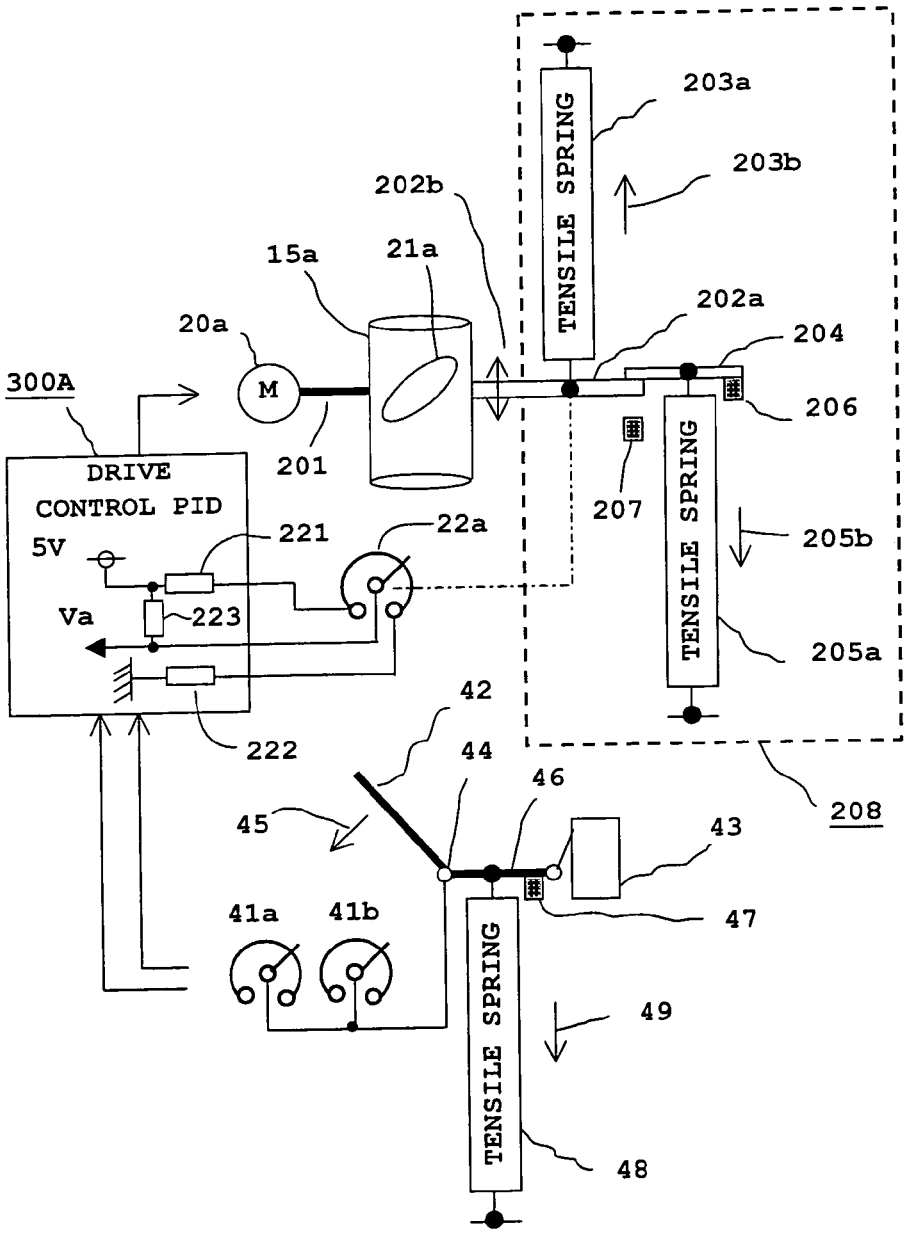
FIG. 3 is a schematic diagram of an initial position return mechanism of the electronic throttle control device for a multi-cylinder engine according to Embodiment 1 of the invention.

Referring now to FIG. 3 showing an initial position return mechanism of the control device of FIG. 1, the intake throttle valve 21*a* in the intake pipe 15*a* for each cylinder performs a valve-opening operation with a rotary shaft 201 of the motor 20*a* and a direct-coupled oscillating section 202*a* interlocks therewith, and for reason of easy understanding, the mentioned oscillating section is shown to operate up and down in the direction of the arrow 202*b*. The direct-coupled oscillating section 202*a* is urged by a tensile spring 205*a* in the direction of the arrow 223*b* (i.e., in the valve-opening direction), and a return member 204 urged by the tensile spring 205*a* in the direction of the arrow 205*b* (i.e., in the valve-closing direction) returns the direct-coupled oscillating section 202*b* in the valve-closing direction. A default stopper 206 regulates the return position.

When the return member 204 drives the direct-coupled oscillating section 202*a* from the returned state position of the default stopper 206 further in the valve-closing direction, the direct-coupled oscillating section 202*a* operates to close up to a position coming in contact with an idle stopper 207.

Accordingly, the motor 20*a* controls a valve opening against the tensile spring 203*a* from the default stopper 206 to the idle stopper 207, and when the valve-opening operation goes over the default stopper 205, the motor 20*a* makes a valve-opening control against the tensile spring 205*a* in cooperation with the tensile spring 203*a*.

When the power source of the motor 20*a* is interrupted, the direct-coupled oscillating section 202*a* performs a valve-closing or valve-opening operation by the actuation of the tensile springs 205*a*, 203*a* up to the position regulated by the default stopper 206, which is a valve-opening position in the evacuation operation at the time of occurrence of any error.

In addition, the throttle position sensor 22*a* is disposed at the operating position of the direct-coupled oscillating section 202*a*, that is, at a position for detecting a valve opening of the throttle, and the initial position return mechanism 208 is comprised of the tensile springs 203*a*, 205*a*, direct-coupled oscillating section 202*a*, return member 204, default stopper 206, etc. The motors 20*b* to 20*d* are also arranged likewise. A dc motor, brush less motor, stepping motor, etc. are employed as the motors 20*b* to 20*d*, and in this Embodiment an on/off ratio controlled dc motor is employed. Control of the dc motor is made by a drive control circuit section 300A in the electronic throttle control device 30A. In the throttle position sensor 22*a*, a potentiometer is employed. The potentiometer is supplied with power from the DC 5V power source in the drive control circuit section 300A via positive and negative dropper resistors 221, 222 so as to obtain a detection signal Va by a turning and sliding terminal to which a pull-up resistor 223 is connected. The throttle position sensors 22*b* to 22*d* are also arranged likewise.

The acceleration pedal 42 is stepped on in the direction of the arrow 45 with a fulcrum 44, and a coupling member 46 is urged in the direction of the arrow 49 by a tensile spring 48 so that the accelerator pedal 42 may be driven in the return direction. A pedal stopper 47 regulates the return position of the accelerator pedal 42 so that the idle switch 43 may detect that the accelerator pedal 42 is not stepped on and is returned to the position of the pedal stopper 47. The pair of accelerator position sensors 41*a*, 41*b* are disposed in dual system to detect a degree of stepping on the acceleration pedal 42, and is provided with positive and negative dropper resistors not illustrated in the same manner as in the throttle position sensor 22*a*. A pull-down resistor not illustrated is connected to a sliding terminal.

In addition, the positive and negative dropper resistors, pull-up resistor and pull-down resistor disposed in the throttle position sensor 22*a* and the accelerator position sensors 41*a*, 41*b* are to obtain a detection output on the safe side at the time of abnormal interruption, and an interruption error or short circuit error is determined when the detection output is, for example, out of the range of 0.5 to 4.5V. In the case where both of the accelerator position sensors 41*a*, 41*b* fall in the interruption error or short circuit error otherwise where the detection outputs of them are not coincident despite that there is neither interruption error nor short circuit error, occurrence of any error is determined in the accelerator position sensors, and only when at least either of the accelerator position sensors is out of such interruption error or short circuit error, detection output thereof is used.

Figure 4:
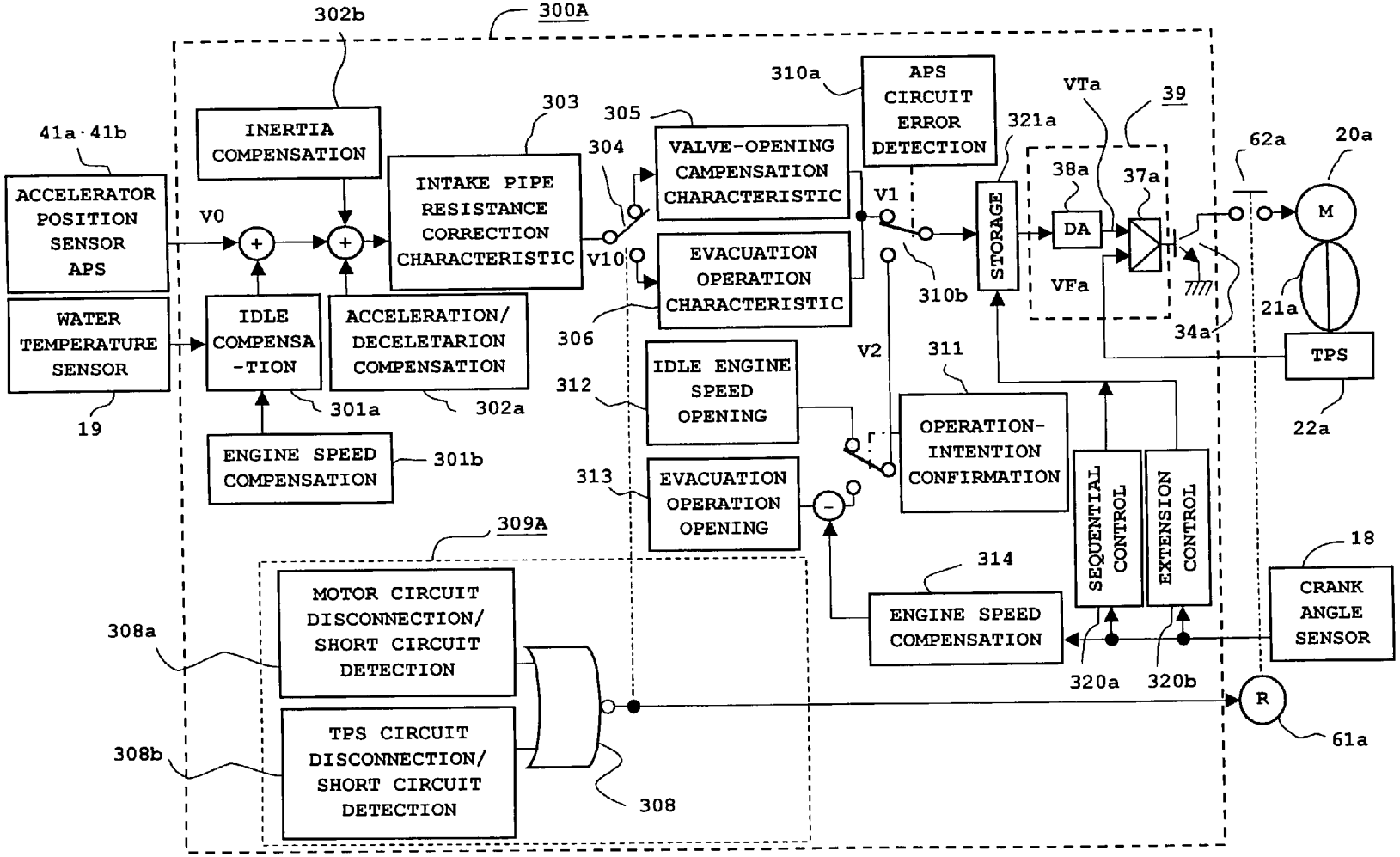
FIG. 4 is a block diagram of a drive control circuit of the electronic throttle control device for a multi-cylinder engine according to Embodiment 1 of the invention.

Referring now to FIG. 4 showing a block diagram of the drive control circuit of the control device of FIG. 1, a detection output of either of the pair of accelerator position sensors 41*a*, 41*b* of which detection outputs are coincident is inputted as a reference target throttle valve opening signal V0 to the drive control circuit section 300A for the motor 20*a* controlling a valve opening of the intake throttle valve 21*a*, and the throttle position sensor 22*a* is inputted as a feedback signal VFa. When an engine temperature detected by the water temperature sensor 19 is low, an idle speed compensation output 301*a* generates an adding compensation output so as to increase the throttle valve opening. Furthermore, when the minimum engine speed for each cylinder measured on the operation time interval of the crank angle sensor 18 is low, engine speed compensation means 301*b* also generates an adding compensation output so as to increase the throttle valve opening. An acceleration-deceleration compensation output 302 generates a compensation output making the throttle valve opening of a cylinder of rapid intake response smaller than that of slow intake response, or causing to reach with a delay the mentioned reference value corresponding to the detection output of the accelerator position sensor, based on a difference between a desired acceleration or deceleration detected by differentiation of the detection outputs of the accelerator position sensors 41*a*, 41*b* and an intake response of the intake pipes 15*a* to 15*d* for each cylinder.

An inertia compensation output 302*b* is a compensation output commonly increasing or decreasing a target throttle valve opening of each cylinder in response to a desired acceleration or deceleration detected on the derivative value of the detection value of the acceleration position sensors 41*a*, 41*b*. A correction control block 303 is a control block for correcting unevenness of intake resistance in the intake pipe, based on a correction characteristic parameter obtained by preliminarily measuring a relation with throttle valve opening for each cylinder at which an intake amount for each cylinder is even, in response to the detection output of the airflow sensor 150*b* disposed on the intake collection pipe 150*a* located upstream of the intake pipes 14*a* to 15*d* for each cylinder and to the engine speed. A correction target throttle valve opening signal V10 is obtained via the correction control block 303.

A compensation control block 305 available when later-described evacuation operation switching means 304 does not act is a control block for compensating the target throttle valve opening for each cylinder so that the target throttle valve opening for each cylinder may be intentionally uneven, based on the valve-opening characteristic parameter defining preliminarily measured appropriate characteristics of the throttle valve opening for each cylinder in order to obtain an engine power efficient as a whole, in response to the degree of stepping on the accelerator pedal and the engine speed.

In addition, in the state that the accelerator pedal is fully stepped on, the mentioned valve-opening characteristic parameter establishes a full throttle state in which the intake throttle valves of all cylinders are fully open. In the state that the accelerator pedal is midway stepped on, the operation is performed being divided into two groups, a first cylinder group of which throttle valve opening is larger than a standard value a little bit and a second cylinder group of which throttle valve opening is a little smaller a little bit. Fuel injection into the mentioned first cylinder group and that into the second cylinder group are alternately performed, and deviation in increase or decrease from the mentioned standard value is restrained to be in the range not actually causing any vibration of vehicle body.

An evacuation control block 306 available when the later-described evacuation operation switching means 304 is actuated, is a control block for determining a throttle valve opening of normal cylinders based on an evacuation characteristic parameter obtained preliminarily measuring a relation with an appropriate throttle valve opening of the remaining cylinders, in response to the number of cylinders being in the fixed throttle valve opening state, the degree of stepping on the accelerator pedal and the engine speed. A storage block 321*a* acting as holding throttle valve opening storage means stores a digital value of a signal voltage proportional to the target throttle valve opening V1 being an output of the compensation control block 305 and the evacuation control block 306 or a digital value of a signal voltage proportional to a later-described alternative target throttle valve opening V2.

A command block 320*a* acting as sequential control means is responsive to the crank angle sensor 18, and only when the cylinder 10*a* is in the exhaust stroke, value of the storage block 321*a* varies and a current value of the target throttle valve opening V1 or the alternative target throttle valve opening V2 is stored. In the strokes of intake, compression and explosion, a timing signal is generated so that a final value in the exhaust stroke is stored and held as the holding throttle valve opening. A control block 320*b* acting as extension control means acts in a state of low engine speed in which on/off operation cycle of the crank angle sensor 18 is over a predetermined value, and expands a variable operation cycle of a storage block 321*a* up to the intake stroke in addition to the exhaust stroke, and a timing signal is generated so that the storing and holding time period is limited to the compression stroke and the explosion stroke.

The feed back control circuit 39 controls an on/off ratio of the switching element 34*a* so that the target analog value VTa obtained by converting the target digital value stored in the storage block 321*a* with a DA converter 38*a* is coincident to the feed back analog value VFa proportional to the detection output of the throttle position sensor 22*a* corresponding to the actual throttle valve opening. A block 308 de-energizes the load power relay 61*a* by a NOR output between an interruption and short-circuit detection output 308*a* of the drive circuit of the motor 20*a* and an interruption and short-circuit detection output 308*b* of the throttle position sensor 22*a*, whereby the output contact 62*a* is open and power supply to the motor 20*a* is stopped.

Alternative target throttle valve opening selection means 310*b* is responsive to a sensor circuit error detection means 310*a* that acts when the accelerator position sensors 41*a*, 41*b* fall in the interruption error or short circuit error otherwise when the detection outputs of them are not coincident despite that there is neither interruption error nor short circuit error, and is means for selectively switching the target throttle valve opening of each cylinder to the alternative target throttle valve opening V2 irrespective of the degree of stepping on the accelerator pedal. Operation-intention confirmation means 311 is means that monitors any action of the idle switch 43 responsive to the full return of the acceleration pedal, a side brake switch responsive to the operation of an auxiliary brake for stopping and holding the vehicle or a select switch acting when a speed change shift bar is changed to the neutral position or parking position, determines whether or not the driver has an intention of moving the vehicle forward or backward, and selects either a first alternative target throttle valve opening 312 or a second alternative target throttle valve opening 313.

The first alternative target throttle valve opening 312 acts when the operation-intention confirmation means 311 determines that there is no operation intention, and is a minimum target throttle valve opening for obtaining an idle engine speed corresponding to a constant minimum engine speed. The second alternative target throttle valve opening 313 acts when the operation-intention confirmation means 311 determines that there is an operation intention, and is an evacuation-operation target throttle valve opening larger than the mentioned minimum target throttle valve opening. Engine speed control means 314 is set speed control means that acts when an engine speed calculated by measuring an operation cycle of the crank angle sensor 18 comes near and goes over a predetermined threshold regulated at the time of evacuation operation, and reduces a value of the alternative target throttle valve opening V2 based on the second alternative target throttle valve opening 313.

The motors 20*a* to 20*d* are subject to the same control, and the reference target throttle valve opening signal V0, the inertia compensation output 302*b*, the second alternative target throttle valve opening 313, the engine speed control means 314, the alternative target throttle valve opening selection means 310*b* and the operation-intention confirmation means 311 are subject to a control common to each motor.

Figure 5:
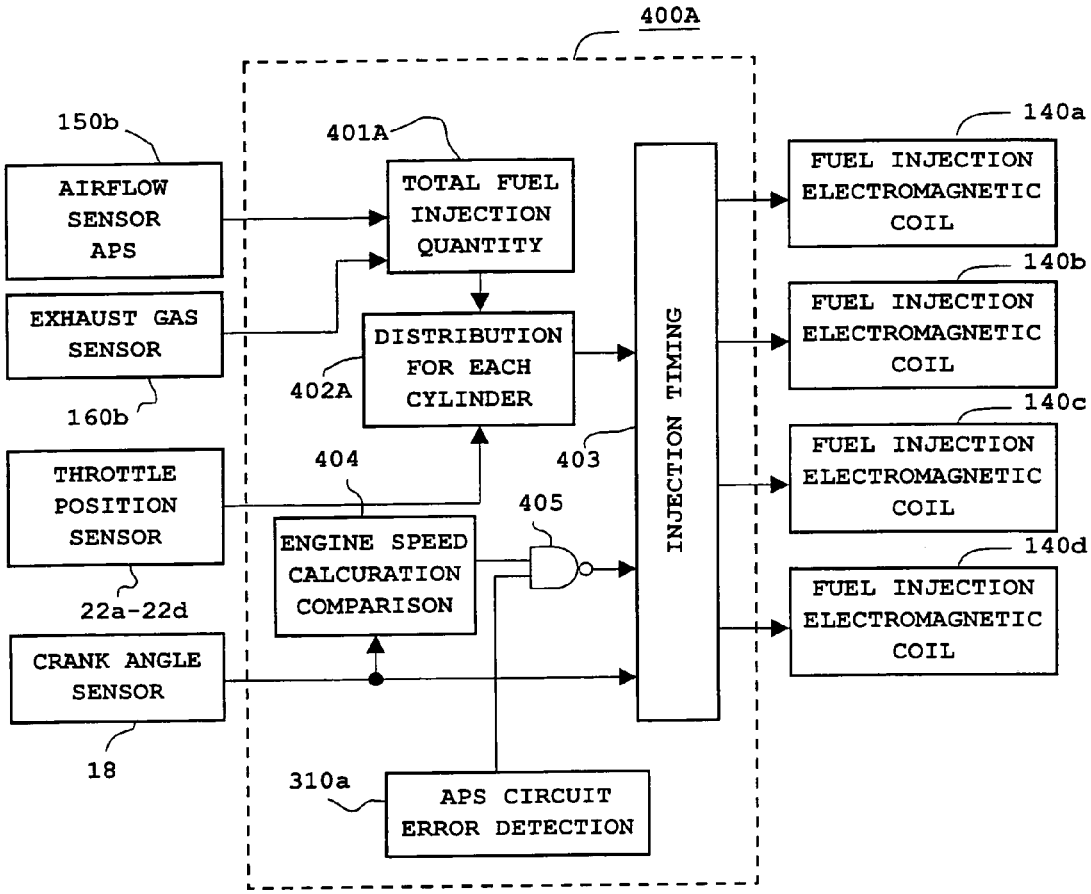
FIG. 5 is a block diagram of fuel injection control means of the electronic throttle control device for a multi-cylinder engine according to Embodiment 2 of the invention.

Referring now to FIG. 5 showing a block diagram of the fuel injection control means of the control device of FIG. 1, control signal of the airflow sensor 150*b*, the exhaust gas sensor 160*b*, the throttle position sensors 22*a* to 22*d*, the crank angle sensor 18, etc. are inputted to the fuel injection control means 400A with respect to fuel injecting electromagnetic valves 14*a* to 14*d*.

Entire air/fuel ratio adjustment means 401A is means for determining a total amount of fuel supply so that a predetermined air/fuel ratio is obtained conforming to a total amount of intake air detected by the airflow sensor 150*b*, adjusting the total amount of fuel supply based on the detection output of the exhaust gas sensor 160*b*, and making a feedback compensation to obtain the predetermined air/fuel ratio. Fuel injection distributing means 402A for each cylinder is means for distributing the mentioned total amount of fuel supply to be a fuel injection amount for each cylinder in response to the detection output of the throttle position sensors 22*a* to 22*d* for each cylinder. Fuel injection timing control means 403 controls drive start timing of the fuel injecting electromagnetic valves 14*a* to 14*d* of each cylinder based on the signal of the crank angle sensor 18, and the drive time period is determined based on the distribution amount of the mentioned fuel injection for each cylinder.

The sensor circuit error detection means 310*a* is a detection block for generating an error output when the accelerator position sensors 41*a*, 41*b* fall in the interruption error or short circuit error otherwise when the detection outputs of them are not coincident despite that there is neither interruption error nor short circuit error. Engine speed detection means 404 is a detection block that detects whether or not an engine speed calculated by measuring an operation cycle of the crank angle sensor 18 goes over a predetermined threshold regulated at the time of evacuation operation. Fuel cut means 405 is a NAND block that acts and generates a fuel injection stopping output when the foregoing detection blocks 310*a*, 404 detect an error output or an engine speed over.

In addition, in the sensor circuit error detection means 310*a*, when not less than three accelerator position sensors are disposed forming a multiple system, en error is determined only when all of the accelerator position sensors disposed forming a multiple system fall in the interruption error or short circuit error otherwise when the coincident detection outputs of them are not obtained despite that there is neither interruption error nor short circuit error.

(2) Detailed Description of the Function and Operation of Embodiment 1:

In Embodiment 1 of the invention arranged as shown in FIGS. 1 to 5, function and operation of each drawing are hereinafter described. Fist referring to FIGS. 2 to 2, the electronic throttle control device 30A with respect to the multi-cylinder engine 10 is mainly comprised of the microprocessor 31 cooperating with the program memory 32A and data memory 33. the electronic throttle control device 30A generates a control output, drives the motors 20*a* to 20*d* that control a valve opening of the intake throttle valves 21*a* to 21*d*, and controls fuel injection timing for each cylinder by applying a current to the electromagnetic coils 140*a* to 140*d* of the fuel injecting electromagnetic valves 14*a* to 14*d*, thus a fuel injection amount being controlled for each cylinder.

A reference value of a target throttle valve opening is determined in response to a detection output of the accelerator position sensors 41*a*, 41*b* disposed in dual system to detect a degree of stepping on the accelerator pedal 42. A total amount of fuel supply is adjusted to maintain a predetermined air/fuel ratio conforming to a detection output of the exhaust gas sensor 160*b* disposed on the exhaust collecting pipe 160*a*, on the basis of a detection output of the exhaust gas sensor 160*b* disposed on the intake collecting pipe 150*a*. The total amount of fuel supply adjusted in this manner is proportionally distributed to a throttle valve opening of each cylinder detected by the throttle position sensors 22*a* to 22*d*. Thus, a fuel injection amount for each cylinder is determined, and fuel injection timing is determined in response to the determined fuel injection amount. When the monitor control circuit section 60A detects any interruption error or short circuit error of the throttle position sensors 22*a* to 22*d* or detects any interruption error or short circuit error of the drive circuit of the motors 20*a* to 20*d*, the load power relays 61*a* to 61*d* are de-energized, and the output contacts 62*a* to 62*d* are open to interrupt the power supply circuit to the motors 20*a* to 20*d*.

When interrupting the power supply to the motors 20*a* to 20*d*, the intake throttle valves 21*a* to 21*d* returns to the predetermined initial positions by means of initial position return mechanism 208.

It is also preferable that an interlocking signal interrupting the switching elements 34*a* to 34*d* is generated in place of the load power relays 61*a* to 61*d*.

Referring to FIG. 4 showing a block arrangement of the motor control in detail, the idle speed compensation output 301*a*, the acceleration-deceleration compensation output 302*a* and the inertia compensation output 302*b* are added to the reference target throttle valve opening signal V0 being a value proportional to the detection output of the accelerator position sensor 41*a* or 41*b*, so that a correction target throttle valve opening signal V10 is obtained through the correction control block 303. In the correction target throttle valve opening signal V10, target values different for each cylinder is intentionally set, whereby difference in intake resistance and intake response for each cylinder is corrected in order to coincide the intake amount of each cylinder.

The compensation control block 305, which is applied at the time of normal operation when error processing means 309A responsive to an interruption or short circuit detection output 308*a* of the motor circuits and an interruption or short circuit detection output 309*a* of the throttle position sensors is not operative, varies intentionally intake amount of each cylinder, and outputs a target throttle valve opening signal V1 for each cylinder to restrain power consumption in the entire power of the engine.

The evacuation control block 306, which is applied at the time of abnormal operation when the error processing means 309A is operated, is located being mixed with the cylinders operated at a fixed throttle valve opening defined by the initial position return mechanism 208, and outputs the target throttle valve opening signal V1 for each cylinder of the remaining cylinders capable of operating normally.

When the sensor error detection means 310*a* detects any error with regard to the accelerator position sensors 41*a*, 41*b*, an alternative target throttle valve signal V2 is selected by the alternative target throttle valve opening selection means 310*b*. When the accelerator pedal 42 returns and the idle switch 43 operates, when the side brake switch detecting operating state of the auxiliary brake for stopping and holding the vehicle operates, or when the operation-intention confirmation means 311 such as selector switch for detecting that the selector bar of the transmission is at the position of neutral or parking determines that there is no intention of operation, then a throttle valve opening to provide an idle speed is selected by the first alternative target throttle valve opening 312. On the other hand, when it is determined that there is an intention of operation, a second alternative target throttle valve opening 313 being a value larger than the first alternative target throttle valve opening 312 is selected.

Vehicle speed at the time of operation with a valve opening determined by the second alternative target throttle valve opening 313 varies depending upon vehicle weight and road inclination, and accordingly adjustment of the vehicle speed is carried out by adjusting the degree of stepping on the acceleration pedal. However, to prevent the engine from over rotating speed, the engine speed control means 314 restrains the throttle valve opening.

In addition, the valve opening of the intake throttle valve 21*a* to 21*d* is preferably controlled to be a target valve opening before the valve opening of the intake valves 11*a* to 11*d* interlocking with the crankshaft, and therefore the valve opening may be zero in the compression stroke and explosion stroke, for example.

However, in the case where the adjustment of valve opening is carried out only in the exhaust stroke by the sequential control means 320*a*, even when the target throttle valve opening varies in the intake stroke, any adjustment of valve opening cannot be carried out during the current intake stroke, and the adjustment is carried out immediately before the next intake stroke.

Accordingly, in the strokes of intake, compression and explosion, by maintaining a throttle valve opening adjusted in the exhaust stroke, amount of adjustment can be smaller in the next adjustment of valve opening, so that control response is improved and the valve opening mechanism is prevented from wear and tear due to over operation. In the case where engine speed is low and the microprocessor 31 has an enough room for the control, controllable time period of the throttle valve opening is extended by extension control means 320, thus adjustment of the idle speed being carries out without delay.

Referring to FIG. 5 showing the fuel injection control means 400A in detail, in this Embodiment 1, the detection output of the airflow sensor 150*b* that detects total intake and the detection output of the exhaust gas sensor 160*b* disposed on the exhaust pipe 160*a* adjust a total amount of fuel supply to reach a predetermined air/fuel ratio, and a fuel injection amount is proportionally distributed for each cylinder based on the detection output of the throttle position sensors 22*a* to 22*d*. Actually the fuel injection amount for each cylinder is determined by proportionally distributing a supposed intake amount for each cylinder. Further, in addition to the engine speed control means 314 shown in FIG. 4, fuel cutting engine speed control means 405 is used in combination.

Additionally, although one throttle position sensor is employed for each intake throttle valve in this embodiment, it is also preferable that the throttle position sensors are disposed in dual system. Further, it is also preferable that means for compensating control characteristics of the evacuation control block 306 by the detection output of the throttle position sensor of the intake throttle valve of the abnormal return is added, in the case where a return position of the intake throttle sensor at the time of interrupting the power supply circuit to the motor is not the predetermined return position.

It is preferable that the monitor control circuit section 60A contains a watchdog timer for monitoring the operation state of the microprocessor 31, and an integrated circuit containing logic circuit elements is arranged including the feedback control circuit section 39. It is preferable that the holding throttle valve opening storage means 321*a* is disposed on the monitor control circuit section 60A, and the digital values Vta to Vtd of the target throttle valve opening are transmitted from the microprocessor 31 to the holding throttle valve opening storage means 321*a* in the monitor control circuit section 60A via a serial communication circuit.

(3) Description of the Features and Advantage of Embodiment 1:

As has been made clear from the above description, an electronic throttle control device according to Embodiment 1 of the invention includes a drive control section 300A of a motor that drives to open and close intake throttle valves 21*a* to 21*d* of a multi-cylinder engine 10 by a microprocessor 31 cooperating with a program memory 32A. The mentioned intake throttle valves 21*a* to 21*d* and throttle valve opening control motors 20*a* to 20*d* are disposed at plural places separately for each cylinder. Further, the mentioned program memory 32A contains a program acting as target throttle valve opening setting means, a program acting as sequential control means, and a program acting as holding throttle valve opening storage means. The mentioned drive control circuit section 300A includes a feedback control circuit section 39 acting with functions separated.

The mentioned target throttle valve opening setting means is means for setting a target throttle valve opening V1 separately for each cylinder or each cylinder group, the target throttle valve opening V1 being obtained by adding or subtracting a compensation output generated conforming to operating conditions on the basis of detection outputs of acceleration position sensors 41*a*, 41*b* that detect a degree of stepping on an accelerator pedal 42. The mentioned sequential control means 320*a* is means for making available only an adjustment and control of the valve opening of the intake throttle valve for a cylinder remaining a predetermined time period immediately before an intake stroke, in response to a crank angle sensor 18 that detects a turning angle position of a crankshaft. The mentioned holding throttle valve opening storage means 321*a* is means for storing a current target value varying depending upon the mentioned target throttle valve opening V1 when the control of throttle valve opening is available by the mentioned sequential control means 320*a*, and storing and holding a value of the target throttle valve opening at the moment immediately before making the control unavailable to establish a holding throttle valve opening when the control of throttle valve opening is made unavailable.

The mentioned feedback control circuit section 39 is a control circuit section for on/off-controlling switching elements 34*a* to 34*d* disposed on a power supply circuit of each of the mentioned motors 20*a* to 20*d* so that a detection output of the throttle position sensors 22*a* to 22*d* detecting a throttle valve opening is equal to the mentioned target throttle valve opening or the mentioned holding throttle valve opening, and in which control burden on the mentioned microprocessor is reduced by sequentially executing the valve opening control for the plural motors.

Compensation output in the mentioned target throttle valve opening setting means is either an idle speed compensation output or an inertia compensation output or both of them. The mentioned idle speed compensation output 301*a* acts in an idle speed state not stepping on the accelerator pedal 42, and is a compensation output increasing or decreasing corresponding to a deviation between a constant minimum engine speed related to cooling water temperature of the engine and a current engine speed. The mentioned inertia compensation output 302*b* is a compensation output increasing or decreasing a target throttle valve opening of each cylinder in response to a desired acceleration or deceleration detected on the derivative value of the detection value of the acceleration position sensors 41*a*, 41*b*.

Accordingly, since a difference in idle speed between the cylinders is corrected by the idle speed compensation output 301*a* and pulsation of the idle engine speed is reduced, a more stable low idle speed can be obtained. Furthermore, since acceleration or deceleration is further improved by the inertia compensation output 302*b*, influence on the operation performance due to increase in vehicle body can be reduced.

The mentioned sequential control means 320*a* is further provided with extension control means 320*b* that acts when the engine speed is not higher than a predetermined value. This extension control means 320*b* is means for controlling a control available time period and makes a part or all of intake stroke time period available in addition to the predetermined time period immediately before the intake stroke. By sequentially executing the valve opening control with respect to plural motors in a partially overlapping manner, control burden on the mentioned microprocessor 31 is reduced.

Accordingly, in the low speed state in which control burden on the microprocessor 31 is reduced, since the control of the throttle valve opening can be continuously performed strictly conforming to the engine speed even in the intake stroke, idle speed control particularly at the time of low temperature can be performed with high accuracy.

The mentioned feedback control circuit section 39 is provided with DA converters 38*a* to 38*d*, which convert a value of the target throttle valve opening or holding throttle valve opening stored in the mentioned holding throttle valve opening storage means 321*a* to an analog value, and comparison control circuits 37*a* to 37*d*. The mentioned comparison control circuits 37*a* to 37*d* are comparison control circuits that control a conduction rate being a ratio between on-time of the mentioned switching elements and on/off cycle so that the mentioned deviation may be zero.

Accordingly, by maintaining a throttle valve on and after the intake stroke as it is, variation amount of the next throttle valve opening is restrained. Thus not only the control response is improved but also wear and tear of the throttle valve drive mechanism is reduced. Furthermore, the control for maintaining the throttle valve opening as it is does not depend upon the microprocessor 31 but carried out by hardware of the feedback control circuit section 39. Thus, any AD converter with respect to the throttle position sensors 22*a* to 22*d* for controlling the throttle valve opening is not required, and control for a response of high quality is achieved.

The mentioned electronic throttle control device 30A includes the fuel injection control means 400A with respect to the fuel injecting electromagnetic valves 14*a* to 14*d*, and the mentioned program memory 32A further contains programs acting as entire air/fuel ratio adjustment means 401A, fuel injection distribution means 402A for each cylinder, and fuel injection timing control means 403.

The mentioned entire air/fuel ratio adjustment means 401A is means for adjusting total fuel supply amount with respect to the all cylinders so as to achieve a predetermined air/fuel ratio in response to the detection output of the airflow sensor 150*b* disposed on the intake collecting pie 150*a* and the detection output of the exhaust gas sensor 160*b* disposed on the exhaust collecting pipe 160*a*. The mentioned fuel injection distribution means 402A for each cylinder is means for distributing the mentioned total fuel supply amount to be a fuel injection amount for each cylinder in response to the detection output of the mentioned throttle position sensors 22*a* to 22*d* for each cylinder. The mentioned fuel injection timing control means 403 is means for controlling drive start timing and drive time period of the fuel injecting electromagnetic valves 14*a* to 14*d* for each cylinder and determining the mentioned drive time period based on the distribution amount of the mentioned fuel injection for each cylinder.

Accordingly, even if the throttle valve openings are different for each cylinder, by controlling the total fuel supply amount of the all cylinders with the use of a just one exhaust gas sensor 160*b*, the air/fuel ratio for each cylinder can be controlled to be substantially an appropriate value.

Further, since the airflow sensor 150*b* is integrated and disposed on the intake collecting pipe 150*a* of less intake pulsation, the entire intake amount can be advantageously measured with high accuracy at reasonable cost.

The control mechanism of the throttle valves including the mentioned motors is provided with an initial position return mechanism 208, and the mentioned electronic throttle control device is further provided with error processing means 309A and evacuation operation switching means 304. The mentioned initial position return mechanism 208 is a mechanism that acts upon interrupting the application of current to the mentioned motors 20*a* to 20*d* and sets the throttle valve opening of the intake pipes 15*a* to 15*d* for each cylinder to return and set to a fixed position. The mentioned error processing means 309A is means that acts when any interruption error or short circuit error is detected in the motor power supply circuit and when any interruption error or short circuit error is detected in the detection circuit of the throttle position sensors, and interrupts the power source of the motors 20*a* to 20*d* or the switching elements 34*a* to 34*d* disposed in the cylinder where the error occurs.

The mentioned evacuation operation switching means 304 is means for selectively switching the throttle valve opening of the remaining normal cylinders in response to the number of cylinders being in the fixed throttle valve opening state, the degree of stepping on the accelerator pedal and the engine speed, in an uncontrolled state that the mentioned error processing means 309A is actuated and a part of the throttle valve openings is initialized by the mentioned initial position return means 208.

Accordingly, even if the throttle valve con troll function for a specific cylinder is lost, the throttle valve opening of the abnormal cylinder is caused to return to a predetermined initial value, and the throttle valve opening of the remaining normal cylinders is controlled, whereby an evacuation operation of high quality being achieved.

The mentioned program memory 32A includes programs each acting as alternative target throttle valve opening selection means 310*b*, operation-intention confirmation means 311, first and second alternative target throttle valve opening setting means 312, 313, and engine speed control means 314. The mentioned alternative target throttle valve opening selection means 310*b* is means that acts when the accelerator position sensors 41*a*, 41*b* disposed in multi-system fall in the interruption error or short circuit error otherwise when the detection outputs of them are not coincident despite that there is neither interruption error nor short circuit error, and selectively switches the target throttle valve opening of each cylinder to the alternative target throttle valve opening V2 irrespective of the degree of stepping on the accelerator pedal 42.

The mentioned operation-intention confirmation means 311 is means that monitors any action of the idle switch 43 responsive to the full return of the acceleration pedal, a side brake switch responsive to the operation of an auxiliary brake for stopping and holding the vehicle or a select switch acting when a speed change shift bar is changed to the neutral position or parking position, and determines whether or not the driver has an intention of moving the vehicle forward or backward.

The first alternative target throttle valve opening 312 acts when the operation-intention confirmation means 311 determines that there is no operation intention, and is a minimum target throttle valve opening for obtaining an idle engine speed corresponding to a constant minimum engine speed. The mentioned second alternative target throttle valve opening 313 acts when the operation-intention confirmation means 311 determines that there is an operation intention, and is an evacuation-operation target throttle valve opening larger than the mentioned minimum target throttle valve opening. The mentioned engine speed control means 314 is set speed control means that compensates the mentioned second alternative target throttle valve opening 313 to reduce gradually along with increase in engine speed of the engine operated at the mentioned second alternative target throttle valve opening 313.

Accordingly, under the condition that a target throttle valve opening cannot be set due to any error of the accelerator position sensors 41*a*, 41*b*, the evacuation operation can be carried out with an alternative target throttle valve opening, and vehicle speed can be adjusted by operating the brake pedal. The mentioned engine speed control means 314 further includes a fuel cut means 405 that stops operation of the fuel injecting electromagnetic valves 14*a* to 14*d* when the engine speed operated with the mentioned second alternative target throttle valve opening goes over (exceeds) a predetermined threshold. Accordingly, even in the case where a target throttle valve opening cannot be set due to any error of the accelerator position sensors 41*a*, 41*b* and an evacuation operation is under way with an alternative target throttle valve opening, the engine speed is prevented from over-speed at the time of running down a sharp gradient, making it possible to carry out an evacuation operation safely.

The microprocessor 31 in the mentioned electronic throttle control device 30A includes fuel injection control means 400A with respect to the fuel injecting electromagnetic valves 14*a* to 14*d* in addition to the throttle valve opening control function. Furthermore, the microprocessor 31 is provided with a monitor control circuit section 60A communicating mutually via a serial communication line.

The mentioned monitor control circuit section 60A, in cooperation with the mentioned microprocessor 31, shares a part of monitoring functions such as detection of interruption and/or short circuit of the mentioned motor circuits, detection of interruption and/or short circuit of the sensor circuits with respect to the mentioned accelerator position sensors or detection of interruption and/or short circuit of the sensor circuits with respect to the mentioned throttle position sensors. Further, the mentioned monitor control circuit section 60A is provided with a drive circuit for the load power relays 61*a* to 61*d*. The load power relays 61*a* to 61*d* are capable of performing their operations on condition that mutual serial communication is normally carried out between the mentioned microprocessor 31 and the monitor control circuit section 60A. Furthermore, since the load power relays 61*a* to 61*d* do not operate unless the serial communication with the monitor control circuit section 60A is normal, safety is improved as a whole.

The mentioned monitor control circuit section 60A includes the mentioned feedback control circuit section 39 and is arranged in the form of a logic circuit integrated into one IC element. As a result, the entire device can be small-sized at a reasonable cost.

The program memory 32A cooperating with the mentioned microprocessor 31 further contains an ignition coil drive control program for power supply to the ignition plugs 13*a* to 13*d* disposed in each cylinder.

As a result, by integrating the functions essential to the control of gasoline engine, the entire device can be formed into a small size at a reasonable cost.

Embodiment 2.

Figure 6:
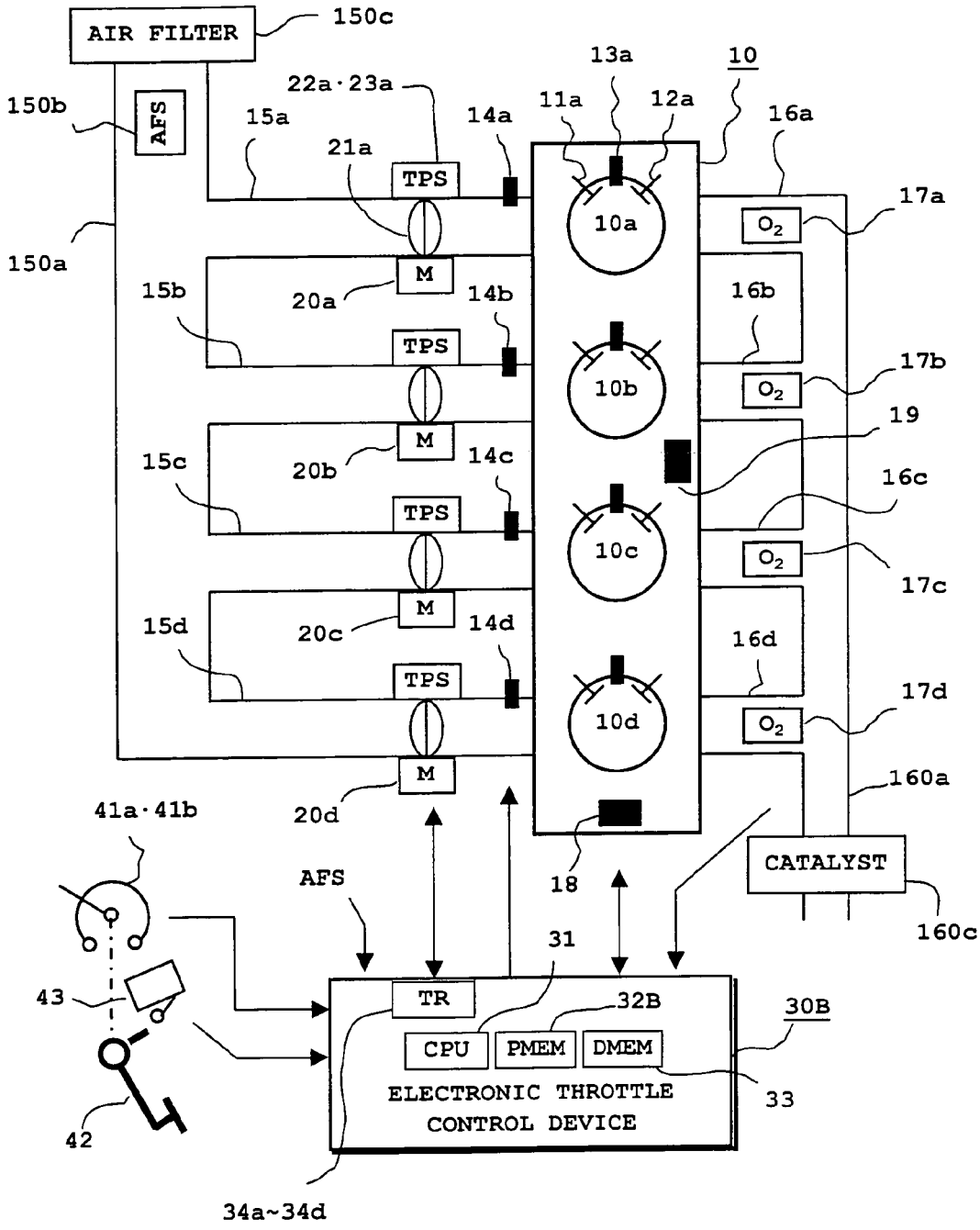
FIG. 6 is a schematic diagram showing an entire mechanism of an electronic throttle control device for a multi-cylinder engine according to Embodiment 2 of the present invention.

(1) Detailed Description of the Features of Embodiment 2:

An electronic throttle control device for a multi-cylinder engine according to Embodiment 2 of the invention is hereinafter described with reference to FIG. 6 showing an entire mechanism of the electronic throttle control device, focusing the differences from the foregoing Embodiment 1 shown in FIG. 1. Referring to FIG. 6, an operation control device 30B for controlling a multi-cylinder engine 10 is mainly comprised of a microprocessor 31 having a program memory 32B and a data memory 33, and drives motors 20*a* to 20*d* in response to detection output of the accelerator position sensors 41*a*, 41*b* that detect a degree of stepping on the accelerator pedal 42 in order to control a valve opening of throttle valves 21*a* to 21*d* disposed on intake pipes 15*a* to 15*d* for each cylinder. Further, the operation control device 30B controls operation timing and time period of fuel injection valves 14*a* to 14*d* in response to total intake air amount detected by an airflow sensor 150*b* disposed on an intake collection pipe 150*a*.

In addition, exhaust gas sensors 17*a* to 17*d* for feedback control of air/fuel ratio are not disposed on an exhaust collecting pipe 160*a* but disposed on exhaust pipes 16*a* to 16*d* for each cylinder, which is a difference in arrangement from the control device of FIG. 1.

Figure 7:
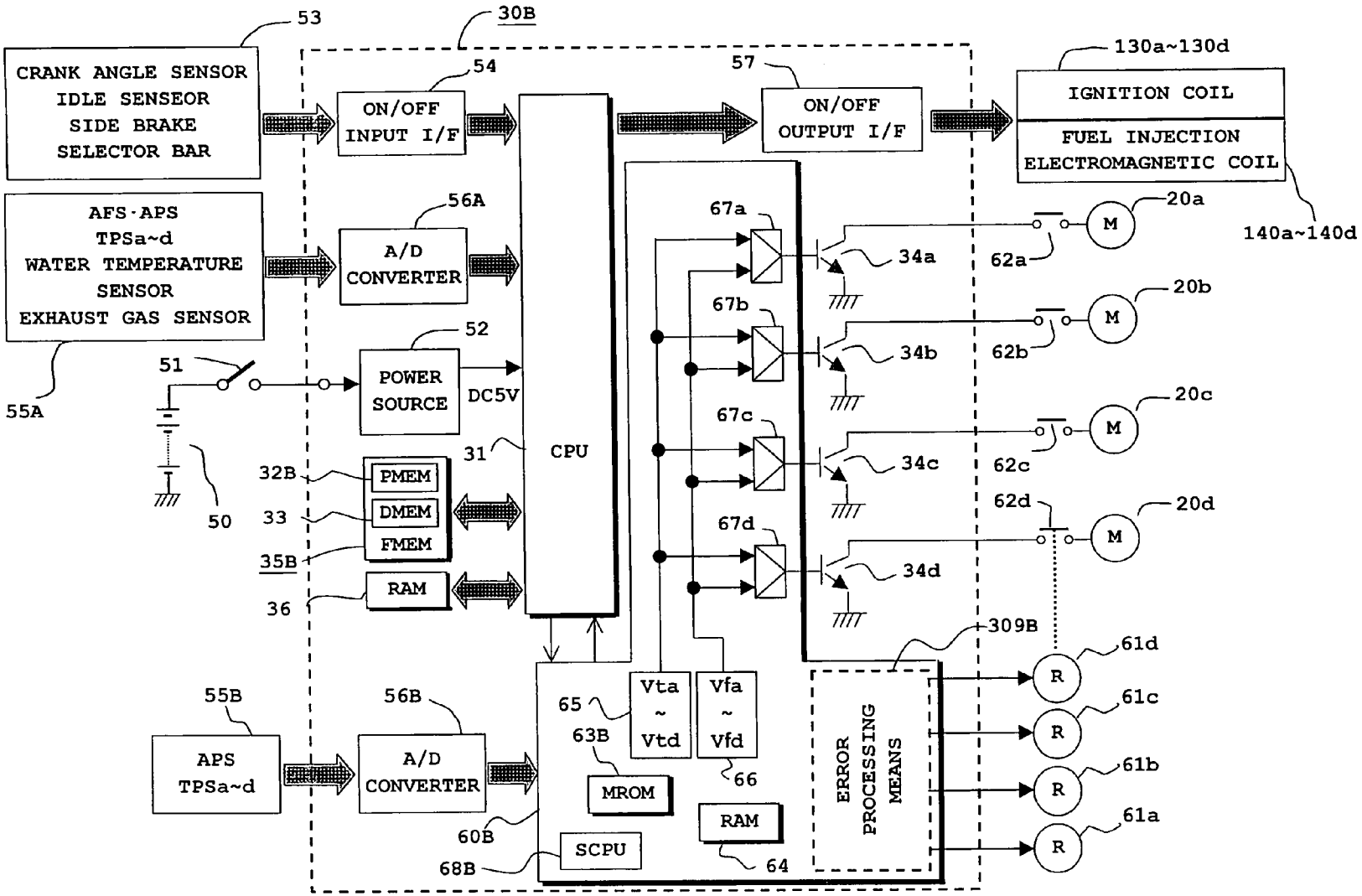
FIG. 7 is a block diagram showing the whole of control blocks of the electronic throttle control device for a multi-cylinder engine according to Embodiment 2 of the invention.

Referring now to FIG. 7 showing a block diagram of the entire control carried out by the control mechanism of FIG. 6, an arrangement of the control device is hereinafter described focusing differences from that shown in FIG. 2. A monitor control circuit section 60B is mainly comprised of an auxiliary microprocessor 68B. This monitor control circuit section 60B is provided with, for example, an auxiliary program memory 63B such as mask ROM memory and an auxiliary RAM memory 64 for operation processing. An analog input sensor group 55B includes accelerator position sensors and throttle position sensors disposed in dual system with respect to an analog input sensor group 55A. A multi-channel AD converter 56B is arranged to convert output signals of the analog input sensor group 55B to digital signals and input them to the monitor control circuit section 60B. In addition, the outputs are dividedly inputted so that the accelerator position sensor 41*a* and throttle position sensors 22*a* to 22*d* belong to the analog input sensor group 55A, and that the accelerator position sensor 41*b* and throttle position sensors 23*a* to 23*d* belong to the analog input sensor group 55B.

A target digital value 65 is a value of target throttle valve openings Vta to Vtd that are calculated by the microprocessor 31, transferred and written into a part of the auxiliary RAM memory 64 via a serial communication circuit. A feedback digital value 66 is a value of actual throttle value openings Vfa to Vfd that is obtained by the throttle position sensors 23*a* to 23*d* via the multi-channel AD converter 56B. Comparison control means 67*a* to 67*d* are executed by a program stored in the auxiliary program memory 63B, and are means for controlling conductivity, being a ratio between on-time and on/off cycle of switching elements 34*a* to 34*d*, so that the target digital value 65 and the feedback digital value 66 are in coincidence, thereby adjusting the throttle valve openings. Error processing means 309B is executed by the auxiliary microprocessor 68B based on the program stored in the auxiliary program memory 63B.

Figure 8:
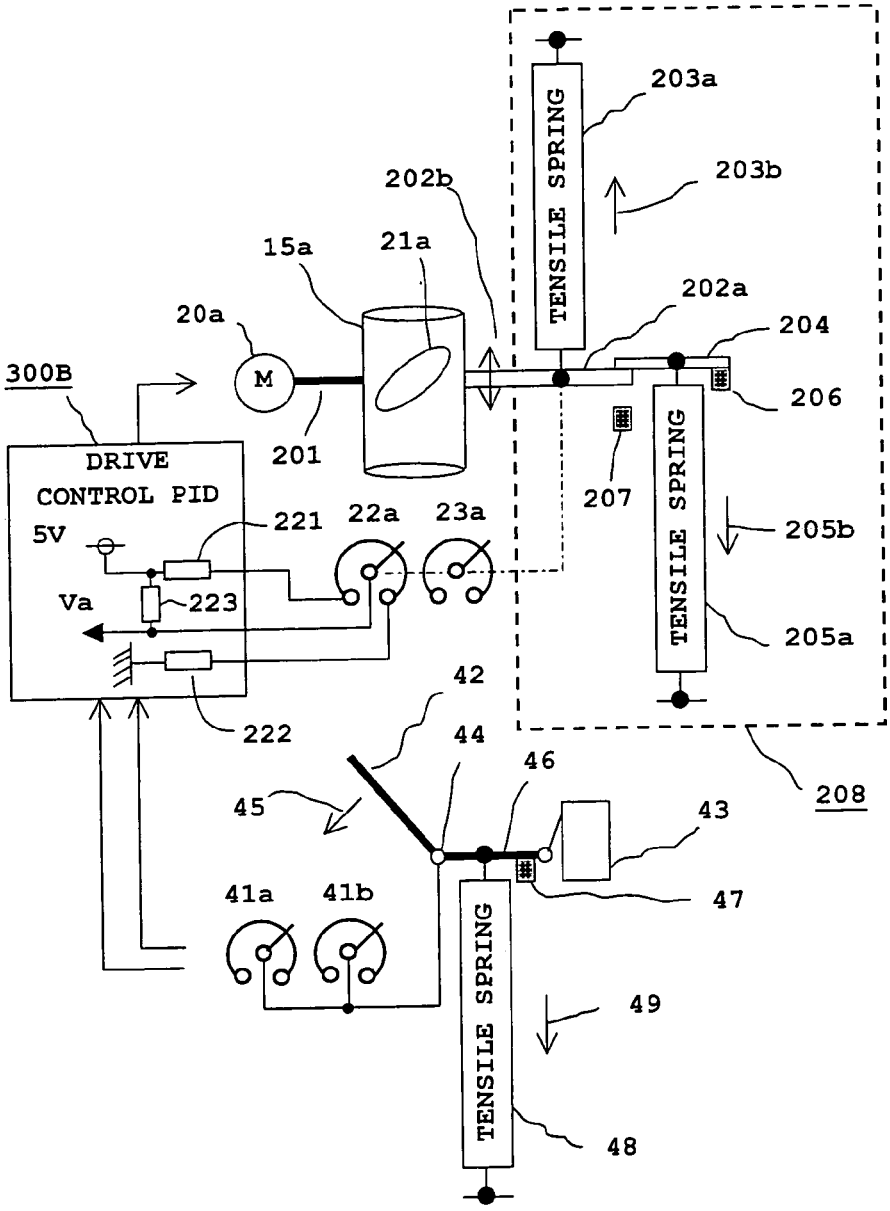
FIG. 8 is a schematic diagram of an initial position return mechanism of the electronic throttle control device for a multi-cylinder engine according to Embodiment 2 of the invention.

Referring now to FIG. 8 showing an initial position return mechanism of the control device of FIG. 6, differences from that shown in FIG. 3 are hereinafter described. With reference to FIG. 8, the motor 20*a* controlled by a drive control section 300B drives opening and closing of the throttle valve 21*a*, and a valve opening thereof is detected by throttle position sensors 22*a*, 23*a* disposed in dual system. One of the accelerator position sensors and the throttle position sensors is inputted to the microprocessor 31 via a multi-channel AD converter 56A, and the other is inputted to the auxiliary microprocessor 68B via the multi-channel AD converter 56B. However, to carry out the determination of coincidence between the accelerator position sensors 41*a* and 41*b*, and the determination of coincidence between the throttle position sensors 22*a* and 23*a*, 22*b* and 23*b*, 22*c* and 23*c*, 22*d* and 23*d*, the detected digital value is transmitted to the auxiliary microprocessor 68B via the serial communication circuit. Thus, the auxiliary microprocessor 68B carries out the determination of error in the sensor circuit of the accelerator position sensors and the throttle position sensors.

Figure 9:
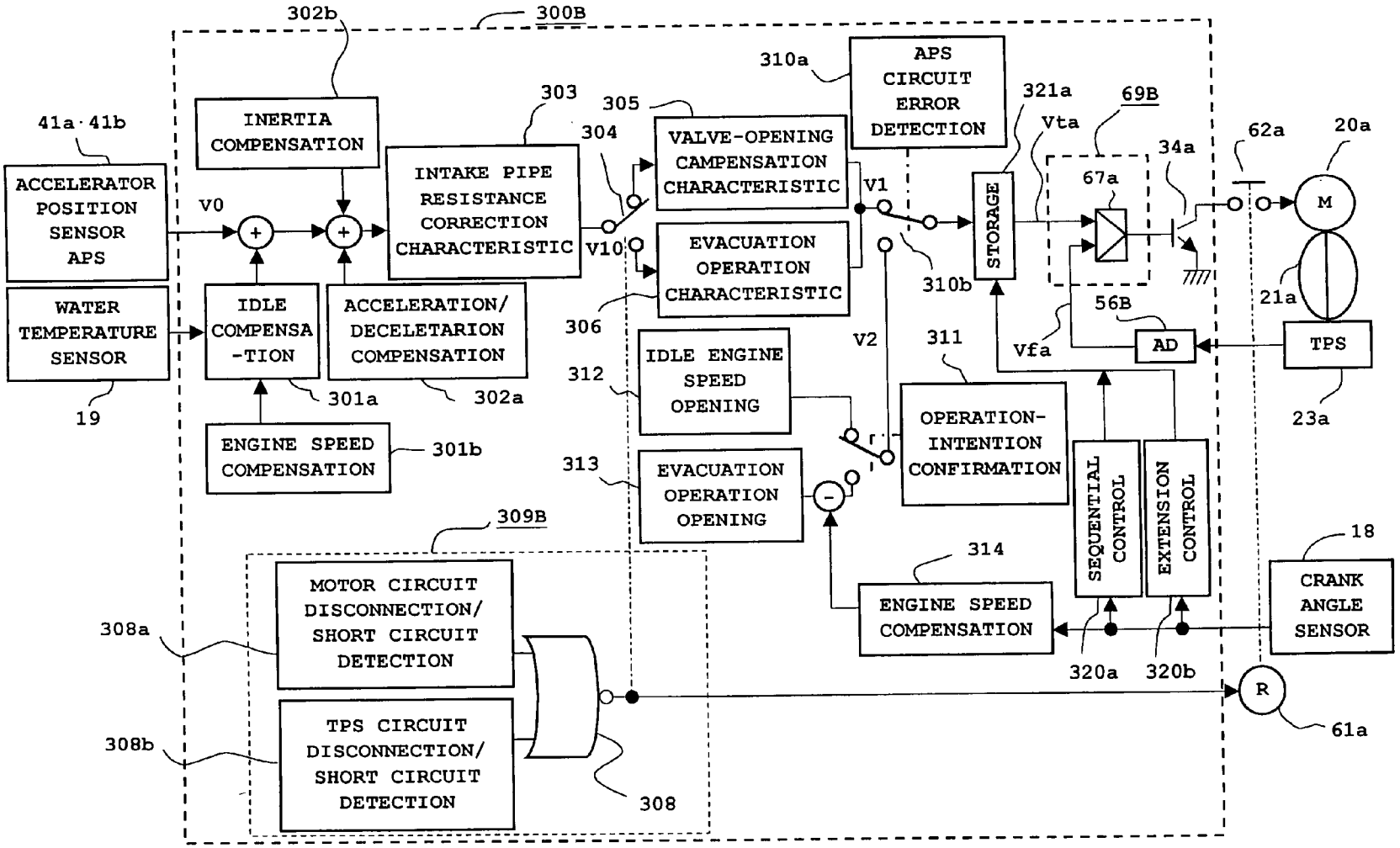
FIG. 9 is a block diagram of a drive control circuit of the electronic throttle control device for a multi-cylinder engine according to Embodiment 2 of the invention.

Referring now to FIG. 9 showing a block diagram of the drive control circuit of FIG. 6, this embodiment is hereinafter described focusing differences from that shown in FIG. 4. With reference to FIG. 9, a feedback control circuit section 69B is comprised of the auxiliary microprocessor 68B (FIG. 7), and drive control of the motor 20*a* is carried out by the comparison control means 67*a* stored in the auxiliary program memory 63B.

The feedback control circuit section 39 in the foregoing Embodiment 1 is arranged in the form of a hardware employing a DA converter and comparison control circuit. On the other hand, the feedback control circuit section 69B in this Embodiment 2 is arranged in the form of software employing the auxiliary microprocessor 68B and the auxiliary program memory 63B.

Figure 10:
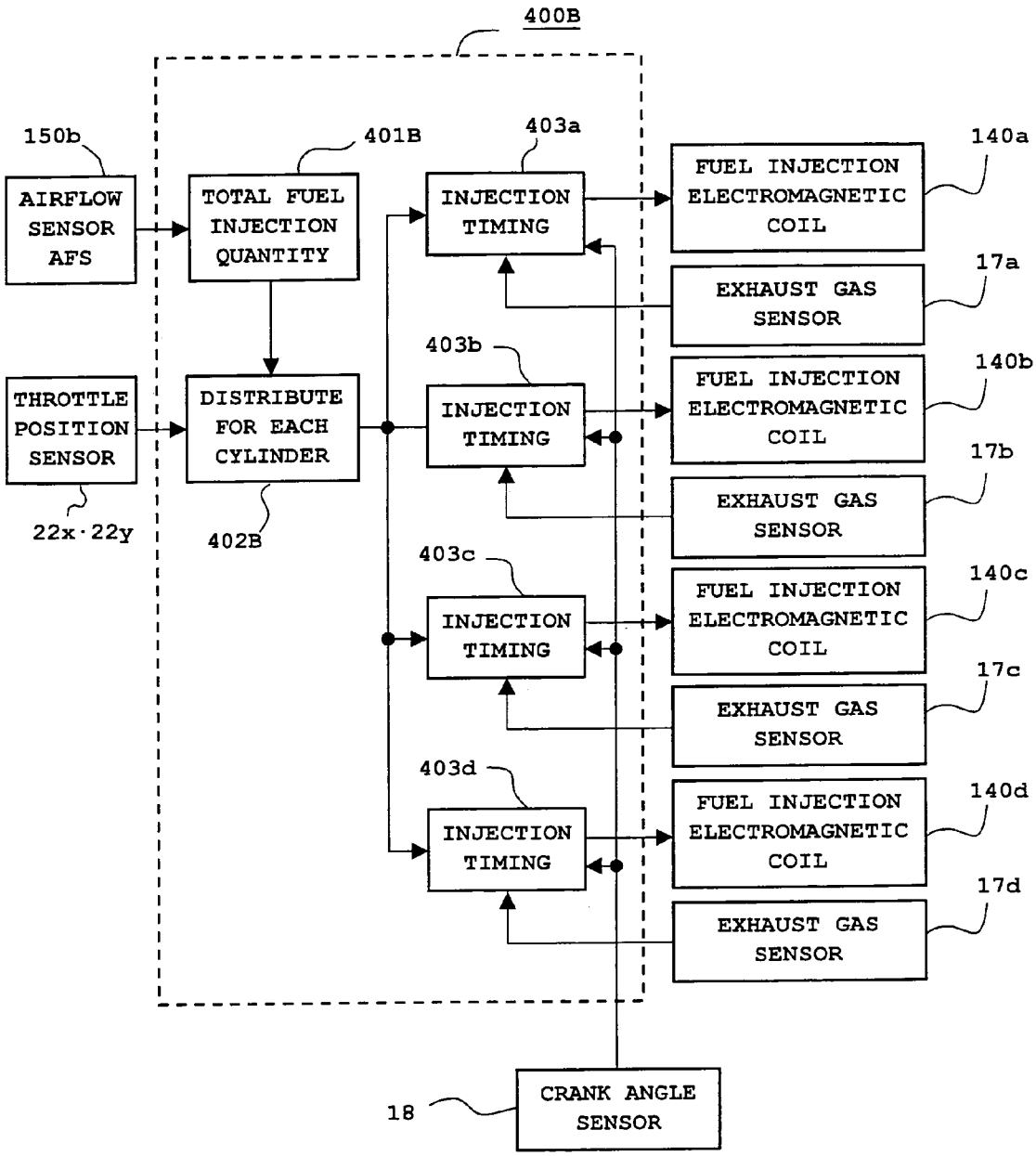
FIG. 10 is a block diagram of fuel injection control means of the electronic throttle control device for a multi-cylinder engine according to Embodiment 2 of the invention.

Referring now to FIG. 10 showing a block diagram of the fuel injection control means of FIG. 6, control signals of the airflow sensor 150*b*, exhaust gas sensors 17*a* to 17*d*, throttle position sensors 22*a* to 22*d*, crank angle sensor 18, etc. are inputted to fuel injection control means 400B with respect to electromagnetic coils 140*a* to 140*d* of fuel injecting electromagnetic valves 14*a* to 14*d*. Total fuel supply amount adjusting means 401B determines a total amount of fuel supply so that a predetermined air/fuel ratio conforming to a total intake amount detected by the airflow sensor 150*b*, and fuel injection distribution means 402B for each cylinder is means for distributing the mentioned total amount of fuel supply to be a fuel injection amount for each cylinder in response to the detection output of the throttle position sensors 22*a* to 22*d* for each cylinder.

Fuel injection timing control means 403*a* to 403*d* control drive start timing and drive time period of the fuel injecting electromagnetic valves 14*a* to 14*d* of each cylinder, and the drive time period is determined based on the distribution amount of the mentioned fuel injection for each cylinder.

However, actual fuel injection amount for each cylinder (drive time period of the fuel injection valves) is adjusted to increase or decrease by the detection output of the exhaust gas sensors 17*a* to 17*d* for each cylinder, and is subject to feedback compensation so as to obtain a predetermined air/fuel ratio.

(2) Detailed Description of the Function and Operation of Embodiment 2:

Function and operation of the control device according to Embodiment 2 of the invention arranged as shown in FIGS. 6 to 10 are hereinafter described. With reference to FIGS. 6 and 7, the electronic throttle control device 30B for the multi-cylinder engine 10 generates a control output mainly by the microprocessor 31 cooperating with the program memory 32B and data memory 33, drives the motors 20*a* to 20*d* that controls valve opening of the intake throttle valves 21*a* to 21*d* disposed on the intake pipes 15*a* to 15*d* for each cylinder, and applies a current to the electromagnetic coils 140*a* to 140*d* of the fuel injecting electromagnetic valves 14*a* to 14*d*.

A reference value of the target throttle valve opening is determined in response to the detection output of the accelerator position sensors 41*a*, 41*b* disposed in dual system in order to detect a degree of stepping on the accelerator pedal 42, and a total amount of fuel supply is determined on the basis of the detection output of the airflow sensor 150*b* disposed on the intake collecting pipe 150*a*. A fuel injection amount for each cylinder is determined by proportional distribution to a throttle valve opening for each cylinder detected by the throttle position sensors 22*a* to 22*d*.

The fuel injection amount for each cylinder determined in this way is separately adjusted so as to maintain a predetermined air/fuel ratio by the detection output of the exhaust gas sensors 17*a* to 17*d* disposed on each exhaust pipe 16*a* to 16*d* for each cylinder.

When the auxiliary microprocessor 68B disposed in the monitor control circuit section 60B detects any interruption error or short circuit error of the throttle position sensors 22*a* to 22*d* and 23*a* to 23*d* or detects any interruption error or short circuit error of the drive circuit of the motors 20*a* to 20*d*, the load power relays 61*a* to 61*d* are de-energized, and the output contacts 62*a* to 62*d* are open to interrupt the power supply circuit to the motors 20*a* to 20*d*.

When interrupting the power supply to the motors 20*a* to 20*d*, the intake throttle valves 21*a* to 21*d* return to the predetermined initial positions by means of initial position return mechanism 208 shown in FIG. 8.

It is also preferable that an interlocking signal interrupting the switching elements 34*a* to 34*d* is generated in place of the load power relays 61*a* to 61*d*.

Referring now to FIG. 9 showing a block arrangement of the motor control in detail, the control operation is substantially the same as in FIG. 4. However, there is a difference in the aspect that the feedback control circuit section 69B is executed by the auxiliary microprocessor 68B. With reference to FIG. 10 showing the fuel injection control means 400B in detail, in this embodiment, exhaust gas sensors 17*a* to 17*d* are disposed for each cylinder, and the compensation control of the fuel injection amount by means of the exhaust gas sensors is carried out for each cylinder.

In the case where the microprocessor 31 is a type of incorporating a multi-channel AD converter therein and in which signals from all analog sensor groups are inputted to the microprocessor 31, it is also preferable that the feedback digital signal 66 of FIG. 7 is transmitted from the microprocessor 31 via the serial communication circuit.

(3) Description of the Features and Advantage of Embodiment 2:

As is obvious from the above description, an electronic throttle control device according to Embodiment 2 of the invention is the electronic throttle control device 30B in which the drive control circuit section 300B is arranged to drive the intake throttle valves 21*a* to 21*d* of the multi-cylinder engine 10 for opening and closing operation thereof by means of the microprocessor 31 cooperating with the program memory 32B. The mentioned intake throttle valves 21*a* to 21*d* and the motors 20*a* to 20*d* for controlling the throttle valve opening are disposed separately for each cylinder. The mentioned program memory 32B contains a program acting as the target throttle valve opening setting means, a program acting as sequential control means, and a program acting as holding throttle valve opening storage means, and the mentioned drive control circuit section 300B is provided with the feedback control circuit section 69B acting with functions being separated.

The mentioned feedback control circuit section 69B is provided with the auxiliary microprocessor 68B cooperating with the auxiliary program memory 63B. This auxiliary program memory 63B contains a program acting as comparison control means 67*a* to 67*d* that acts establishing a value of the target throttle valve opening or the holding throttle valve opening stored in the mentioned holding throttle valve opening storage means as a target digital value. The mentioned comparison control means 67*a* to 67*d* are means for controlling conductivity, being a ratio between on-time and on/off cycle of switching elements 34*a* to 34*d*, in response to a deviation between the mentioned target digital value 65 and the feedback digital value 66, being a digitally converted value with respect to the mentioned throttle position sensors 23*a* to 23*d*, so that the mentioned deviation may be zero.

Accordingly, maintaining steady the throttle valve opening on and after the intake stroke restrains variation amount of the next throttle valve opening. As a result, not only control response can be improved but also wear and tear of the throttle valve drive mechanism can be reduced.

Furthermore, the steady maintaining control is carried out by the auxiliary microprocessor 68B disposed on the feedback control circuit section 69B without depending upon the microprocessor 31. Accordingly, no DA converter is necessary with respect to the target throttle valve opening and the holding throttle valve opening, resulting in a control of high precision. The mentioned electronic throttle control device 30B includes the fuel injection control means 400B with respect to the fuel injecting electromagnetic valves 14*a* to 14*d*, and the mentioned program memory 32B further contains a program acting as the total fuel supply amount adjusting means 401B, the fuel injection distributing means 402B for each cylinder, and the fuel injection timing control means 403*a* to 403*d*.

The mentioned total fuel supply amount setting means 401B is means for setting a total fuel supply amount with respect to all cylinders in proportion to the detection output of the airflow sensor 150*b* disposed on the intake collecting pipe 150*a*. The mentioned fuel injection distributing means 402B for each cylinder is means for distributing the mentioned total fuel supply amount into a fuel injection amount for each cylinder in response to the detection output of the mentioned throttle position sensors 22*a* to 22*d* for each cylinder.

The mentioned fuel injection timing control means 403*a* to 403*d* are means for controlling drive start timing and drive time period of the fuel injecting electromagnetic valves 14*a* to 14*d* of each cylinder. The drive start timing is determined based on the distribution amount of the mentioned fuel injection for each cylinder, and the drive time period of the fuel injecting electromagnetic valves 14*a* to 14*d* of each cylinder is controlled in response to the detection output of the exhaust gas sensors 17*a* to 17*d* disposed on the exhaust pipes 16*a* to 16*d* for each cylinder.

Accordingly, even if there is a difference in throttle valve opening of each cylinder or there is a variation in fuel injection control characteristic of each cylinder, air/fuel ratio of each cylinder can be exactly controlled using the exhaust gas sensors 17*a* to 17*d* disposed on exhaust pipes 16*a* to 16*d* for each cylinder. Further, since the airflow sensor 150*b* is collectively disposed on the intake collecting pipe 150*a* of less intake pulsation, there is an advantage of measuring the entire intake amount with high accuracy at reasonable cost.

The mentioned monitor control circuit section 60B includes the mentioned feedback control circuit section 69B and is comprised of the auxiliary microprocessor 68B cooperating with the auxiliary program memory 63B.

As a result, arranging the entire device to be small size and simple and changing the control program with respect to the auxiliary program memory 63B can easily change the control specification.

Embodiment 3.

(1) Detailed Description of the Features of Embodiment 3:

Embodiment 2.

Figure 11:
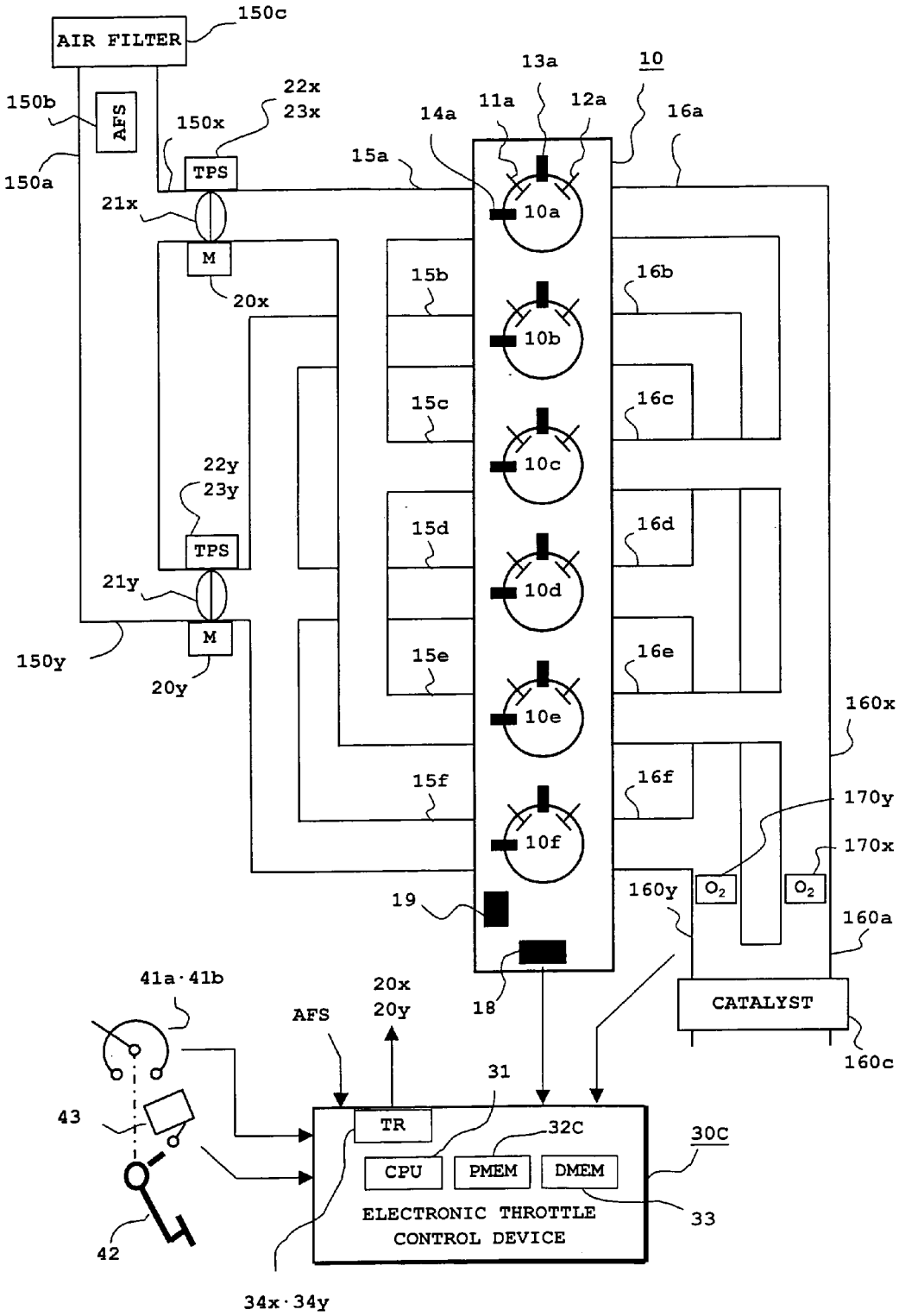
FIG. 11 is a schematic diagram showing an entire mechanism of an electronic throttle control device for a multi-cylinder engine according to Embodiment 3 of the present invention.

(1) Detailed Description of the Features of Embodiment 2:

An electronic throttle control device for a multi-cylinder engine according to Embodiment 3 of the invention is hereinafter described with reference to FIG. 11 showing an entire mechanism of the electronic throttle control device, focusing the differences from the foregoing Embodiment 1 shown in FIG. 1. Referring to FIG. 11, an operation control device 30C controlling the multi-cylinder engine 10 is mainly comprised of the microprocessor 31 containing a program memory 32*c* and a data memory 33, and drives motors 20*x*, 20*y* in response to the detection output of the accelerator position sensors 41*a*, 41*b* that detect a degree of stepping on the accelerator pedal 42. The operation control device 30C controls a valve opening of throttle valves 21*x*, 21*y* disposed on branch collecting pipes 150*x*, 150*y*, and controls operation timing and time period of the fuel injection valves 14*a* to 14*d* in response to the total intake amount detected by the airflow sensor 150*b* disposed on the intake collecting pipe 150*a*.

The mentioned branch collecting pipe 150*x* is arranged in such a manner as to serve as a common passage to the intake pipe 14*a*, 15*c*, 15*e* for each cylinder and communicate to the intake collecting pipe 150*a*. The mentioned branch collecting pipe 150*y* is arranged in such a manner as to serve as a common passage to the intake pipe 15*b*, 15*d*, 15*f* for each cylinder and communicates to the intake collecting pipe 150*a*. Exhaust gas sensors 170*x*, 170*y* for making a feedback control of air/fuel ratio are disposed on exhaust pipes 160*x*, 160*y* for each cylinder. The exhaust pipe 160*x* for a cylinder is arranged in such a manner as to serve as a common passage to the intake pipe 16*a*, 16*c*, 16*e* for each cylinder and communicates to the intake collecting pipe 160*a*. The exhaust pipe 160*y* for a cylinder is arranged in such a manner as to serve as a common passage to the intake pipe 16*b*, 16*d*, 16*f* for each cylinder and communicates to the intake collecting pipe 160*a*.

Figure 12:
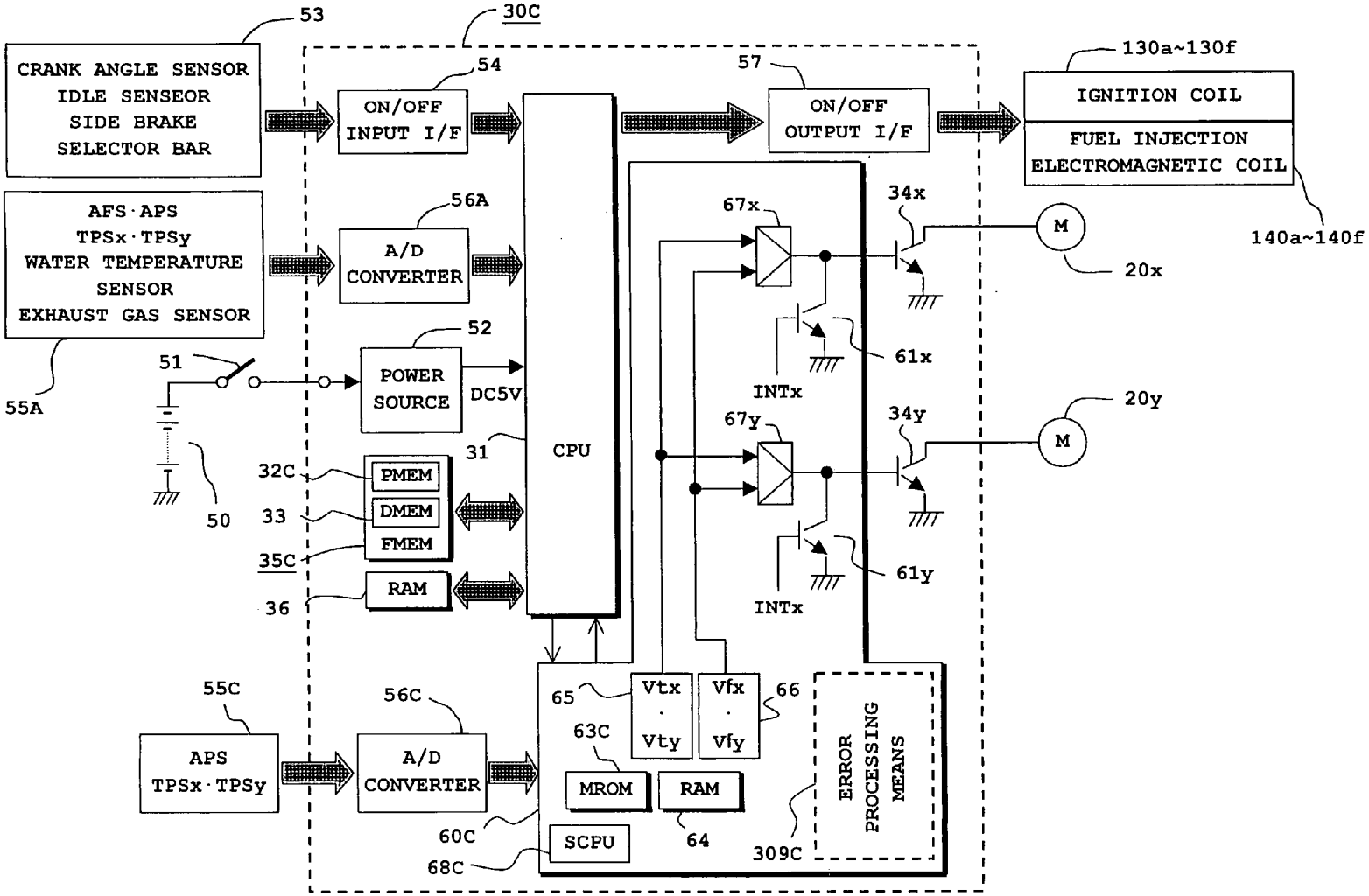
FIG. 12 is a block diagram showing the whole of control blocks of the electronic throttle control device for a multi-cylinder engine according to Embodiment 3 of the invention.

Referring now to FIG. 12 showing the entire block diagram of the entire mechanism of the electronic throttle control device shown in FIG. 11, an arrangement of the control device is hereinafter described focusing the differences from that shown in FIG. 11. With reference to FIG. 12, a monitoring control circuit section 60C mainly consists of an auxiliary microprocessor 68C. This auxiliary microprocessor 68C is provided with an auxiliary program memory 63C such as mask ROM memory and an auxiliary RAM memory 64 for operation processing. An analog input sensor group 55C includes accelerator position sensors and throttle position sensors disposed in dual system with respect to an analog input sensor group 55A. A multi-channel AD converter 56C is arranged to convert output signals of the analog input sensor group 55C to digital signals and input them to the auxiliary microprocessor 68C.

In addition, the outputs are dividedly inputted so that the accelerator position sensor 41*a* and throttle position sensors 22*x* to 22*y* belong to the analog input sensor group 55A, and that the accelerator position sensor 41*b* and throttle position sensors 23*x* to 23*y* belong to the analog input sensor group 55C.

A target digital value 65 is a value of target throttle valve openings Vtx and Vty that are calculated by the microprocessor 31, transferred and written into a part of the auxiliary RAM memory 64 via a serial communication circuit. A feedback digital value 66 is a value of actual throttle value openings Vfx and Vfy that is obtained by the throttle position sensors 23*x* and 23*y* via the multi-channel AD converter 56C. Comparison control means 67*x* and 67*y* are executed by a program stored in the auxiliary program memory 63C, and are means for controlling conductivity, being a ratio between on-time and on/off cycle of switching elements 34*x* and 34*y*, so that the target digital value 65 and the feedback digital value 66 are in coincidence, thereby adjusting the throttle valve openings.

Figure 13:
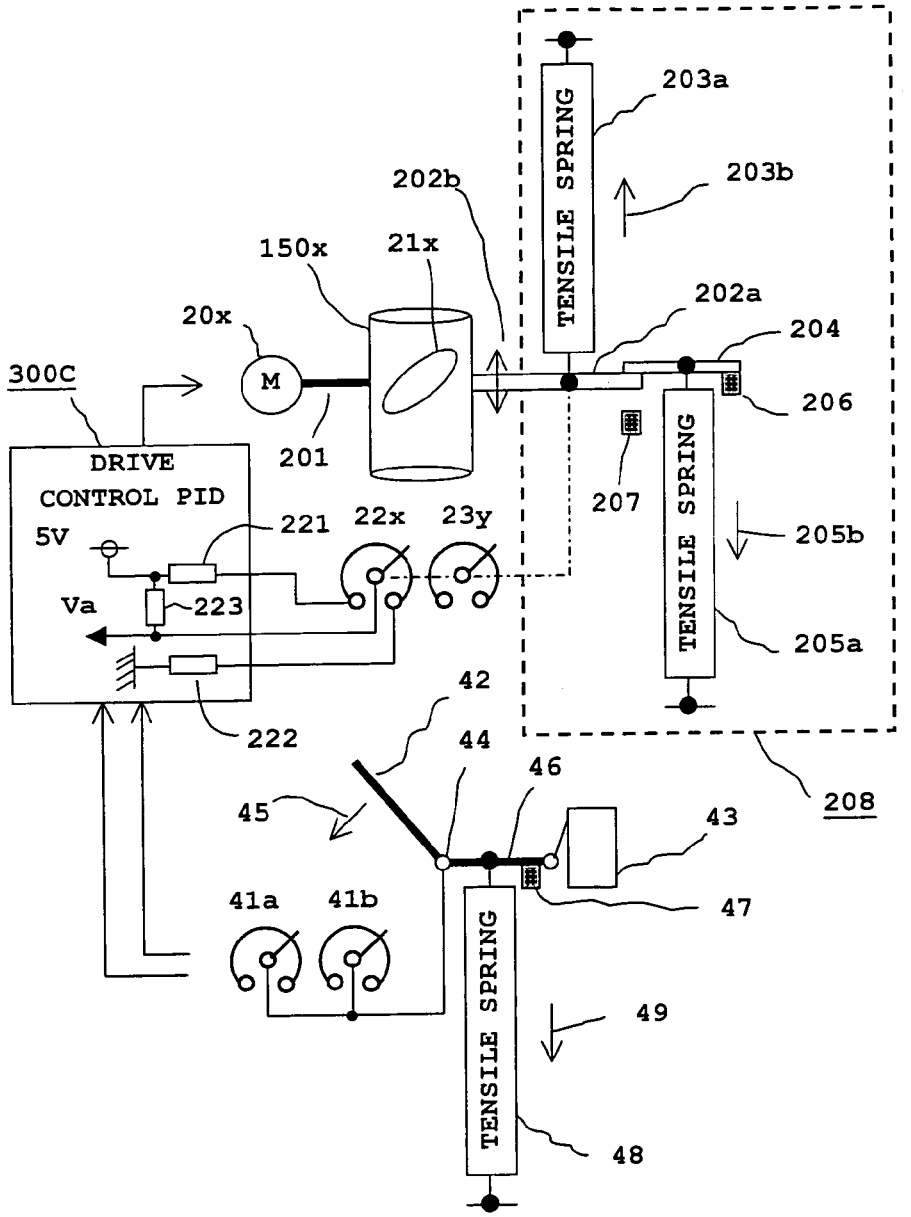
FIG. 13 is a schematic diagram of an initial position return mechanism of the electronic throttle control device for a multi-cylinder engine according to Embodiment 3 of the invention.

Referring now to FIG. 13 showing an initial position return mechanism of the control device of FIG. 11, differences from that shown in FIG. 3 are hereinafter described. With reference to FIG. 13, the motor 20*x* controlled by a drive control section 300C drives opening and closing of the throttle valve 21*x*, and a valve opening thereof is detected by throttle position sensors 22*x*, 23*y* disposed in dual system. One of the accelerator position sensors and the throttle position sensors is inputted to the microprocessor 31 via a multi-channel AD converter 56A, and the other is inputted to the auxiliary microprocessor 68C via the multi-channel AD converter 56C.

Figure 14:
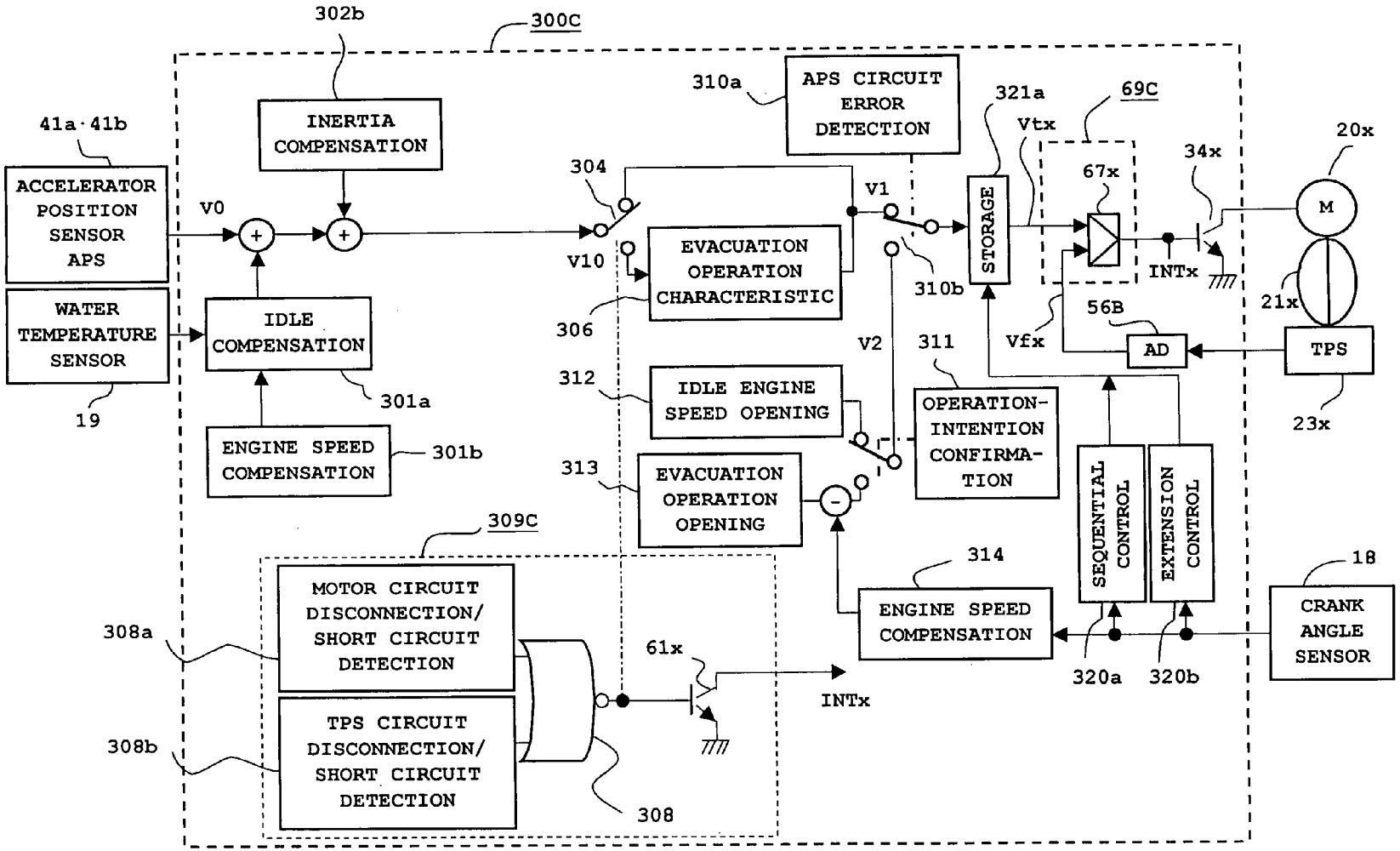
FIG. 14 is a block diagram of a drive control circuit of the electronic throttle control device for a multi-cylinder engine according to Embodiment 3 of the invention.

Referring now to FIG. 14 showing a block diagram of the drive control circuit of FIG. 11, this embodiment is hereinafter described focusing differences from that shown in FIG. 4. With reference to FIG. 14, a feedback control circuit section 69C is comprised of the auxiliary microprocessor 68C (FIG. 7), and drive control of the motor 20*x* is carried out by the comparison control means 67*x* stored in the auxiliary program memory 63C.

The feedback control circuit section 39 in the foregoing Embodiment 1 is arranged in the form of a hardware employing a DA converter and comparison control circuit. On the other hand, the feedback control circuit section 69C in this Embodiment 3 is arranged in the form of software employing the auxiliary microprocessor 68C and the auxiliary program memory 63C. Furthermore, the error processing means 309C drives interlock elements 61*x* and 61*y* instead of the load power relays 61*a* to 61*d*, and it is arranged such that conduction of transistors acting as these interlock elements stops driving the switching elements 34*x* and 34*y*.

Figure 15:
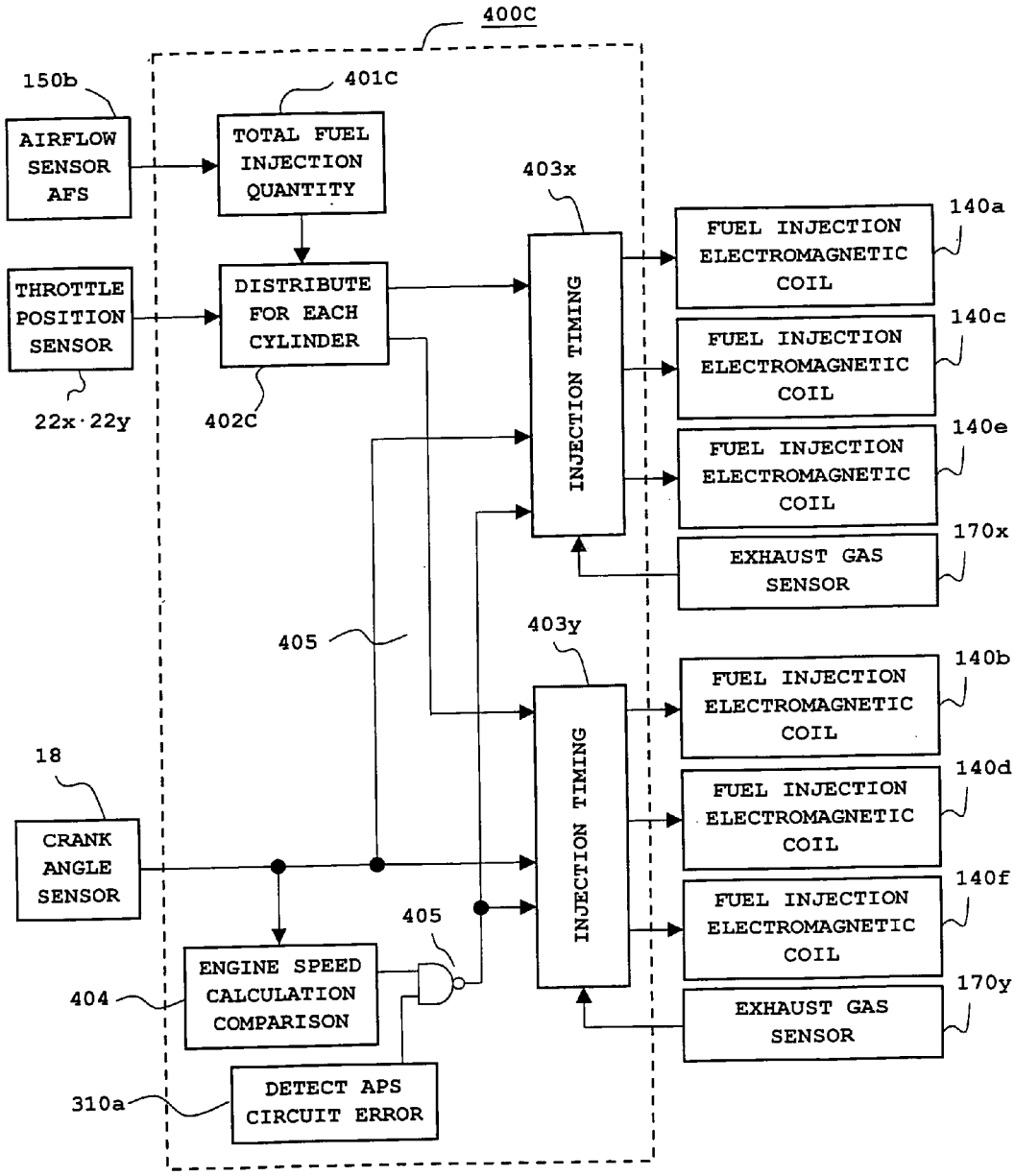
FIG. 15 is a block diagram of fuel injection control means of the electronic throttle control device for a multi-cylinder engine according to Embodiment 3 of the invention.

Referring now to FIG. 15 showing a block diagram of the fuel injection control means of FIG. 11, control signals of the airflow sensor 150*b*, exhaust gas sensors 170*x* and 170*y*, throttle position sensors 22*x* and 22*y*, crank angle sensor 18, etc. are inputted to fuel injection control means 400C with respect to electromagnetic coils 140*a* to 140*f* of fuel injecting electromagnetic valves 14*a* to 14*f*. Total fuel supply amount adjusting means 401C determines a total amount of fuel supply so that a predetermined air/fuel ratio conforming to a total intake amount detected by the airflow sensor 150*b*, and fuel injection distribution means 402C for each cylinder is means for distributing the mentioned total amount of fuel supply to be a fuel injection amount for each cylinder in response to the detection output of the throttle position sensors 22*x* and 22*y* for each cylinder.

Fuel injection timing control means 403*x* and 403*y* control drive start timing and drive time period of the fuel injecting electromagnetic valves 14*a* to 14*f* of each cylinder, and the drive time period is determined based on the distribution amount of the mentioned fuel injection for each cylinder.

However, actual fuel injection amount for each cylinder (drive time period of the fuel injection valves) is adjusted to increase or decrease by the detection output of the exhaust gas sensors 170*x* and 170*y* for each cylinder, and is subject to feedback compensation so as to obtain a predetermined air/fuel ratio.

(2) Detailed Description of the Function and Operation of Embodiment 3:

Function and operation of the control device according to Embodiment 3 of the invention arranged as shown in FIGS. 11 to 15 are hereinafter described. With reference to FIGS. 11 and 12, the electronic throttle control device 30C for the multi-cylinder engine 10 generates a control output mainly by the microprocessor 31 cooperating with the program memory 32C and data memory 33, drives the motors 20*x* and 20*y* that control valve opening of the intake throttle valves 21*x* to 21*y* disposed on the intake pipes 150*x* and 150*y* for each cylinder, and applies a current to the electromagnetic coils 140*a* to 140*f* of the fuel injecting electromagnetic valves 14*a* to 14*f*.

A reference value of the target throttle valve opening is determined in response to the detection output of the accelerator position sensors 41*a*, 41*b* disposed in dual system in order to detect a degree of stepping on the accelerator pedal 42, and a total amount of fuel supply is determined on the basis of the detection output of the airflow sensor 150*b* disposed on the intake collecting pipe 150*a*. A reference value of the fuel injection amount for each cylinder is determined by proportional distribution to a throttle valve opening for each cylinder detected by the throttle position sensors 22*x* and 22*y*.

The fuel injection amount for each cylinder determined in this way is separately adjusted so as to maintain a predetermined air/fuel ratio by the detection output of the exhaust gas sensors 170*x* and 170*y* disposed on each exhaust pipe 160*x* and 160*y* for each cylinder.

When the auxiliary microprocessor 68C disposed in the monitor control circuit section 60C detects any interruption error or short circuit error of the throttle position sensors 22*x* and 22*y*, and 23*x* and 23*y* or detects any interruption error or short circuit error of the drive circuit of the motors 20*x* and 20*y*, the interlock elements 61*x* and 61*y* are conducted, and the switching elements 34*x* and 34*y* are open to interrupt the power supply circuit to the motors 20*x* and 20*y*. When interrupting the power supply to the motors 20*x* and 20*y*, the intake throttle valves 21*x* and 21*y* return to the predetermined initial positions by means of initial position return mechanism 208 shown in FIG. 13. Referring to FIG. 14 showing a block arrangement of the motor control in detail, the control operation is substantially the same as in FIG. 4. However, there is a difference in the aspect that the feedback control circuit section 69C is executed by the auxiliary microprocessor 68C.

The error processing means 309C is arranged to drive the interlock elements 61*x* and 61*y* instead of the load power relays. Referring to FIG. 15 showing the fuel injection control means in detail, the control means according to this embodiment is provided with exhaust gas sensors 170*x* and 170*y* for each cylinder, and compensation control of the fuel injection amount is carried out by the exhaust gas sensors separately for each cylinder.

In the case where the microprocessor 31 is a type of incorporating a multi-channel AD converter therein and in which signals from all analog sensor groups are inputted to the microprocessor 31, it is also preferable that the feedback digital signal 66 of FIG. 12 is transmitted from the microprocessor 31 via the serial communication circuit.

(3) Description of the Features and Advantage of Embodiment 3:

As is obvious from the above description, an electronic throttle control device according to Embodiment 3 of the invention is the electronic throttle control device 30C in which the drive control circuit section 300C is arranged to drive the intake throttle valves 21*x* and 21*y* of the multi-cylinder engine 10 for opening and closing operation thereof by means of the microprocessor 31 cooperating with the program memory 32C. The mentioned intake throttle valves 21*x* and 21*y* and the motors 20*x* and 20*y* for controlling the throttle valve opening are disposed separately for each cylinder group. The mentioned program memory 32C contains a program acting as the target throttle valve opening setting means, a program acting as sequential control means, and a program acting as holding throttle valve opening storage means, and the mentioned drive control circuit section 300C is provided with the feedback control circuit section 69C acting with functions being separated.

The mentioned intake throttle valves 21*x* and 21*y* for each cylinder group are disposed in the first and second branch collecting pipes 150*x* and 150*y*. Each of the branch collecting pipes 150*x* and 150*y* acts as a common intake passage with respect to a three-cylinder engine, and the cylinders belonging to the first branch collecting pipe 150*x* and the second branch collecting pipe 150*y* are located to be in a relation of receiving an intake stroke alternately.

Accordingly, by making a control of the intake throttle valves with respect to the six-cylinder engine in an electrically interlocking manner, arrangement of the mechanism becomes easy. Further, since the control of the throttle valve opening is sequentially subject to time sharing processing in each cylinder without duplication, control burden on the microprocessor 31 does not increase, and it becomes possible to manage a series of controls such as fuel injection control, ignition control, etc. in a unitary manner by means of just one microprocessor.

The electronic throttle control device 30C includes fuel injection control means 400C with respect to the fuel injecting electromagnetic valves 14*a* to 14*f*, and the mentioned program memory 32C further contains programs acting as the total fuel supply amount adjusting means, the fuel injection distributing means for each cylinder group, and the fuel injection timing control means. The mentioned total fuel supply amount setting means 401C is means for setting a total fuel supply amount with respect to all cylinders in proportion to the detection output of the airflow sensor 150*b* disposed on the intake collecting pipe 150*a*. The mentioned fuel injection distributing means 402C for each cylinder group is means for distributing the mentioned total fuel supply amount into a fuel injection amount for each cylinder in response to the detection output of the mentioned throttle position sensors 22*x* and 22*y* for each cylinder.

The mentioned fuel injection timing control means 403*x* and 403*y* are means for controlling drive start timing and drive time period of the fuel injecting electromagnetic valves 14*a* to 14*f* of each cylinder. A reference value of the drive time period is determined based on the injection amount resulted from proportional distribution of the mentioned fuel injection amount for each cylinder group to the corresponding cylinders. The drive time period of the fuel injecting electromagnetic valves of each cylinder group is controlled in response to the detection output of the exhaust gas sensors 170*x* and 170*y* disposed on the exhaust pipes 160*x* and 160*y* for each cylinder group.

Accordingly, even if there is a difference in throttle valve opening of each cylinder or there is a variation in fuel injection control characteristic of each cylinder, air/fuel ratio of each cylinder group can be exactly controlled using the exhaust gas sensors 170*x* and 170*y* disposed on exhaust pipes 160*x* and 160*y* for each cylinder group. Further, since the airflow sensor 150*b* is collectively disposed on the intake collecting pipe 150*a* of less intake pulsation, there is an advantage of measuring the entire intake amount with high accuracy at reasonable cost.

The control mechanism of the throttle valves including the mentioned motors is provided with an initial position return mechanism 208, and the mentioned electronic throttle control device is further provided with error processing means 309C and evacuation operation switching means 304. The mentioned initial position return mechanism 208 is a mechanism that acts upon interrupting the application of current to the mentioned motors 20*x* and 20*y* and sets the throttle valve opening of the intake throttle valves 21*x* and 21*y* disposed on the branch collecting pipes 150*x* and 150*y* to return and set to a fixed position. The mentioned error processing means 309C is means that acts when any interruption error or short circuit error is detected in the motor power supply circuit and when any interruption error or short circuit error is detected in the detection circuit of the throttle position sensors, and interrupts the power source of the motors 20*x* and 20*y* or the switching elements 34*x* and 34*y* disposed in the cylinder group where the error occurs.

The mentioned evacuation operation switching means 304 is means for selectively switching the throttle valve opening of cylinder group on the normal side, in an uncontrolled state that the mentioned error processing means 309C is actuated and the throttle valve opening of one cylinder group is initialized by the mentioned initial position return means.

Accordingly, even if the throttle valve con troll function for a specific cylinder group is lost, the throttle valve opening of the abnormal cylinder group is caused to return to a predetermined initial value, and the throttle valve opening of the remaining normal cylinder group is controlled, whereby an evacuation operation of high quality being achieved.

The microprocessor 31 in the mentioned electronic throttle control device 30C includes fuel injection control means 400C with respect to the fuel injecting electromagnetic valves 14*a* to 14*f* in addition to the throttle valve opening control function. Furthermore, the microprocessor 31 is provided with a monitor control circuit section 60C communicating mutually via a serial communication line.

The mentioned monitor control circuit section 60C, in cooperation with the mentioned microprocessor 68, shares a part of monitoring functions such as detection of interruption and/or short circuit of the mentioned motor circuits, detection of interruption and/or short circuit of the sensor circuits with respect to the mentioned accelerator position sensors or detection of interruption and/or short circuit of the sensor circuits with respect to the mentioned throttle position sensors. Further, the mentioned monitor control circuit section 60C is provided with interlock elements 61*x* and 61*y* that interrupt the switching elements 34*x* and 34*y* for driving the motors 20*x* and 20*y* of the system where error occurs. The switching elements 34*x* and 34*y* are capable of performing their operations on condition that mutual serial communication is normally carried out between the mentioned microprocessor 31 and the monitor control circuit section 60C.

Accordingly, to cope with the control burden on the microprocessor 31 resulted from performing the fuel injection control in addition to the control of throttle valve opening, the monitor control circuit section 60C is disposed in combination, whereby the burden of monitor control function is reduced. Furthermore, since the interlock elements 61*x* and 61*y* do not operate unless both monitor control circuit section 60C and serial communication with the monitor control circuit section 60C are normal, safety as a whole is improved.

While the presently preferred embodiments of the present invention have been shown and described, it is to be understood that these disclosures are for the purpose of illustration and that various changes and modifications may be made without departing from the scope of the invention as set forth in the appended claims.

What is claimed is:

1. An electronic throttle control device comprising a drive control circuit section of a motor that drives to open and close intake throttle valves of a multi-cylinder engine by a microprocessor cooperating with a program memory;

wherein said intake throttle valves and throttle valve opening control motors are disposed at plural places separately for each cylinder or each cylinder group;

said program memory contains a program acting as target throttle valve opening setting means, a program acting as sequential control means, and a program acting as holding throttle valve opening storage means;

said drive control circuit section is provided with a feedback control circuit section acting with functions separated;

said target throttle valve opening setting means is means for setting a target throttle valve opening separately for each cylinder or each cylinder group, the target throttle valve opening being obtained by adding or subtracting a compensation output generated conforming to operating conditions on the basis of detection outputs of acceleration position sensors, that detect a degree of stepping on an accelerator pedal;

said sequential control means is means for making available only an adjustment and control of the valve opening of the intake throttle valve for a cylinder remaining a predetermined time period immediately before an intake stroke, in response to a crank angle sensor that detects a turning angle position of a crankshaft;

said holding throttle valve opening storage means is means for storing a current target value varying in accordance with said target throttle valve opening when the control of throttle valve opening is available by said sequential control means, and storing and holding a value of the target throttle valve opening at the moment immediately before making the control unavailable to establish a holding throttle valve opening when the control of throttle valve opening is made unavailable; and said feedback control circuit section is a control circuit section for on/off-control of switching elements disposed on a power supply circuit of each of said motors so that a detection output of the throttle position sensors detecting a throttle valve opening is equal to said target throttle valve opening or said holding throttle valve opening; and the valve opening control for the plural motors is sequentially executed.

2. The electronic throttle control device according to claim 1, wherein said intake throttle valves for each cylinder group are disposed in the first and second branch collecting pipes, each of said branch collecting pipes acts as a common intake passage with respect to a three-cylinder engine, and the cylinders belonging to the first branch collecting pipe and the second branch collecting pipe are located to be in a relation of receiving an intake stroke alternately.

3. The electronic throttle control device according to claim 2, further comprising fuel injection control means with respect to the fuel injecting electromagnetic valves; wherein said program memory further contains programs acting as a total fuel supply amount adjusting means, fuel injection distributing means for each cylinder group, and fuel injection timing adjustment means; said total fuel supply amount setting means is means for setting a total fuel supply amount with respect to all cylinders in proportion to the detection output of the airflow sensor disposed on the intake collecting pipe; said fuel injection distributing means for each cylinder group is means for distributing said total fuel supply amount to be a fuel injection amount for each cylinder group in response to the detection output of said throttle position sensors for each cylinder group; and said fuel injection timing adjustment means are means for controlling drive start timing and drive time period of the fuel injecting electromagnetic valves of each cylinder; determining a reference value of the drive time period based on the injection amount resulted from proportional distribution of said fuel injection amount for each cylinder group to the corresponding cylinders; and adjusting the drive time period of the fuel injecting electromagnetic valves of each cylinder group in response to the detection output of the exhaust gas sensors disposed on the exhaust pipes for each cylinder group.

4. The electronic throttle control device according to claim 2, wherein the control mechanism of the throttle valves including the mentioned motors is provided with an initial position return mechanism; the electronic throttle control device further comprising error processing means and evacuation operation switching means; said initial position return mechanism is a mechanism that acts upon interrupting the application of current to said motors and sets the throttle valve opening of the intake throttle valves disposed on the branch collecting pipes for each cylinder group to return to a fixed position; said error processing means is means that acts when any interruption error or short circuit error is detected in the motor power supply circuit and when any interruption error or short circuit error is detected in the detection circuit of the throttle position sensors, and interrupts the power source of the motors or the switching elements disposed in the cylinder group where the error occurs; and said evacuation operation switching means is means for selectively switching the throttle valve opening of cylinder group on the normal side, in an uncontrolled state that said error processing means is actuated and the throttle valve opening of one cylinder group is initialized by said initial position return means.

5. The electronic throttle control device according to claim 1, wherein the compensation output in said target throttle valve opening setting means is either an idle speed compensation output or an inertia compensation output or both of them; said idle speed compensation output acts in an idle speed state not stepping on the accelerator pedal, and is a compensation output increasing or decreasing corresponding to a deviation between a constant minimum engine speed related to cooling water temperature of the engine and a current engine speed; and said inertia compensation output is a compensation output increasing or decreasing a target throttle valve opening of each cylinder in response to a desired acceleration or deceleration detected on the derivative outputs of the detection value of the acceleration position sensors.

6. The electronic throttle control device according to claim 1, wherein said sequential control means is provided with extension control means that acts when the engine speed is not higher than a predetermined value; said extension control means is means for controlling a control available time period and makes a part or all of intake stroke time period available in addition to the predetermined time period immediately before the intake stroke; and the valve opening control with respect to plural motors is sequentially executed in a partially overlapping manner.

7. The electronic throttle control device according to claim 1, wherein said feedback control circuit section is provided with DA converters, which convert a value of the target throttle valve opening or holding throttle valve opening stored in said holding throttle valve opening storage means to an analog value, and comparison control circuits; said comparison control circuits are comparison control circuits that control a conduction rate being a ratio between on-time of said switching elements and on/off cycle so that said deviation may be zero.

8. The electronic throttle control device according to claim 1, wherein said feedback control circuit section is provided with an auxiliary microprocessor cooperating with the auxiliary program memory; said auxiliary program memory contains a program acting as comparison control means that acts establishing a value of the target throttle valve opening or the holding throttle valve opening stored in the mentioned holding throttle valve opening storage means as a target digital value; and said comparison control means are means for controlling conductivity, being a ratio between on-time and on/off cycle of switching elements, in response to a deviation between said target digital value and the feedback digital value, being a digitally converted value with respect to said throttle position sensors, so that said deviation may be zero.

9. The electronic throttle control device according to claim 1, further comprising a fuel injection control means with respect to the fuel injecting electromagnetic valves; wherein said program memory further contains programs acting as entire air/fuel ratio adjustment means, fuel injection distribution means for each cylinder, and fuel injection timing control means; said entire air/fuel ratio adjustment means is means for adjusting total fuel supply amount with respect to the all cylinders so as to achieve a predetermined air/fuel ratio in response to a detection output of the airflow sensor disposed on the intake collecting pipe and a detection output of an exhaust gas sensor disposed on the exhaust collecting pipe; said fuel injection distribution means for each cylinder is means for distributing said total fuel supply amount to be a fuel injection amount for each cylinder in response to a detection output of said throttle position sensors for each cylinder; and said fuel injection timing control means is means for controlling drive start timing and drive time period of the fuel injecting electromagnetic valves for each cylinder and determining said drive time period based on the distribution amount of said fuel injection for each cylinder.

10. The electronic throttle control device according to claim 1, further comprising a fuel injection control means with respect to the fuel injecting electromagnetic valves; wherein said program memory further contains programs acting as total fuel supply setting means, fuel injection distribution means for each cylinder, and fuel injection timing adjustment means; said total fuel supply setting means is means for setting a total fuel supply amount with respect to all cylinders in proportion to a detection output of the airflow sensors disposed on the intake collecting pipes; said fuel injection distribution means for each cylinder is means for distributing said total fuel supply amount to be a fuel injection amount for each cylinder in response to the detection output of said throttle position sensors for each cylinder; and said fuel injection timing adjustment means is means for controlling drive start timing and drive time period of the fuel injecting electromagnetic valves for each cylinder, determining a reference value of the drive time period based on the distribution amount of said fuel injection amount for each cylinder, and adjusting the drive time period of the fuel injecting electromagnetic valves of each cylinder in response to a detection output of exhaust gas sensors disposed on the exhaust pipes for each cylinder.

11. The electronic throttle control device according to claim 1, wherein the control mechanism of the throttle valves including said motors is provided with an initial position return mechanism; the electronic throttle control device further comprising error processing means and evacuation operation switching means; said initial position return mechanism is a mechanism that acts upon interrupting the application of current to said motors and sets the throttle valve opening of the intake pipes for each cylinder to return to a fixed position; said error processing means is means that acts when any interruption error or short circuit error is detected in the motor power supply circuit and when any interruption error or short circuit error is detected in the detection circuit of the throttle position sensors, and interrupts the power source of the motors or the switching elements disposed in the cylinder where the error occurs; and said evacuation operation switching means is means for selectively switching the throttle valve opening of the remaining normal cylinders in response to the number of cylinders being in the fixed throttle valve opening state, the degree of stepping on the accelerator pedal and the engine speed, in an uncontrolled state that said error processing means is actuated and a part of the throttle valve openings is initialized by said initial position return means.

12. The electronic throttle control device according to claim 1, wherein said program memory includes programs each acting as alternative target throttle valve opening selection means, operation-intention confirmation means, first and second alternative target throttle valve opening setting means, and engine speed control means; said alternative target throttle valve opening selection means is means that acts when the accelerator position sensors disposed in multi-system fall in the interruption error or short circuit error or when the detection outputs of them are not coincident despite that there is neither interruption error nor short circuit error, and selectively switches the target throttle valve opening of each cylinder to the alternative target throttle valve opening irrespective of the degree of stepping on the accelerator pedal; said operation-intention confirmation means is means that monitors any action of the idle switch responsive to the full return of the acceleration pedal, a side brake switch responsive to the operation of an auxiliary brake for stopping and holding the vehicle or a select switch acting when a speed change shift bar is changed to the neutral position or parking position, and determines whether or not the driver has an intention of moving the vehicle forward or backward; said first alternative target throttle valve opening acts when said operation-intention confirmation means determines that there is no operation intention, and is a minimum target throttle valve opening for obtaining an idle engine speed corresponding to a constant minimum engine speed; said second alternative target throttle valve opening acts when said operation-intention confirmation means determines that there is an operation intention, and is an evacuation-operation target throttle valve opening larger than the mentioned minimum target throttle valve opening; said engine speed control means is set speed control means that compensates said second alternative target throttle valve opening to reduce gradually along with increase in engine speed of the engine operated at said second alternative target throttle valve opening.

13. The electronic throttle control device according to claim 12, wherein said engine speed control means includes a fuel cut means that stops operation of the fuel injecting electromagnetic valves when the engine speed operated with said second alternative target throttle valve opening exceeds a predetermined threshold.

14. The electronic throttle control device according to claim 1, wherein the microprocessor includes fuel injection control means with respect to the fuel injecting electromagnetic valves in addition to the throttle valve opening control function; the microprocessor is provided with a monitor control circuit section communicating mutually via a serial communication line; said monitor control circuit section, in cooperation with said microprocessor, shares a part of monitoring functions such as detection of interruption and/or short circuit of said motor circuits, detection of interruption and/or short circuit of the sensor circuits with respect to said accelerator position sensors or detection of interruption and/or short circuit of the sensor circuits with respect to said throttle position sensors; said monitor control circuit section is further provided with a drive circuit for the load power relays that interrupt the power source of the motors of the system where error occurs, or interlock elements that interrupt switching elements for driving the motors of the system where error occurs; said load power relays and switching elements for driving the motors are capable of performing their operations on condition that mutual serial communication is normally carried out between said microprocessor and monitor control circuit section.

15. The electronic throttle control device according to claim 14, wherein said monitor control circuit section includes said feedback control circuit section and is arranged in the form of a logic circuit integrated into one IC element.

16. The electronic throttle control device according to claim 14, wherein said monitor control circuit section includes said feedback control circuit section, and comprises said auxiliary microprocessor cooperating with the auxiliary program memory.

17. The electronic throttle control device according to claim 14, wherein said program memory cooperating with said microprocessor further contains an ignition coil drive control program for power supply to ignition plugs disposed in each cylinder.

* * * * *